US008092198B2

(12) United States Patent
Kobayashi et al.

(10) Patent No.: US 8,092,198 B2
(45) Date of Patent: Jan. 10, 2012

(54) FUEL PUMP FOR INTERNAL COMBUSTION ENGINE

(75) Inventors: Masayuki Kobayashi, Kasugai (JP); Hitoshi Shibata, Okazaki (JP); Tatsumi Oguri, Okazaki (JP)

(73) Assignee: Denso Corporation, Kariya (JP)

( * ) Notice: Subject to any disclaimer, the term of this patent is extended or adjusted under 35 U.S.C. 154(b) by 791 days.

(21) Appl. No.: 12/167,531

(22) Filed: Jul. 3, 2008

(65) Prior Publication Data

US 2009/0010789 A1 Jan. 8, 2009

(30) Foreign Application Priority Data

Jul. 6, 2007 (JP) ..... 2007-178904

(51) Int. Cl.
*F04B 53/10* (2006.01)

(52) U.S. Cl. ..... 417/559; 417/568; 417/440; 417/304; 417/302; 417/441; 137/513.3; 137/513.7

(58) Field of Classification Search ..... 417/559, 417/568, 440, 304, 311, 302, 441; 137/513.3, 137/513.7; 123/506
See application file for complete search history.

(56) References Cited

U.S. PATENT DOCUMENTS

| | | | | |
|---|---|---|---|---|
| 2,591,401 A | | 4/1952 | Hilding | |
| 2,622,613 A | * | 12/1952 | McNeal | 137/469 |
| 4,080,988 A | * | 3/1978 | Robertson | 137/513.3 |
| 4,328,827 A | * | 5/1982 | Enjolras | 137/512.2 |
| 4,432,215 A | * | 2/1984 | Yoshida | 62/324.6 |
| 4,648,369 A | | 3/1987 | Wannenwetsch | |
| 5,639,229 A | * | 6/1997 | Cooke | 417/440 |
| 2006/0222538 A1 | | 10/2006 | Inoue et al. | |
| 2007/0110603 A1 | | 5/2007 | Usui et al. | |
| 2009/0291006 A1 | | 11/2009 | Inoue et al. | |

FOREIGN PATENT DOCUMENTS

| | | |
|---|---|---|
| EP | 1411238 | 4/2004 |
| GB | 1216682 A | 12/1970 |
| JP | 10-148168 | 6/1998 |
| JP | 2001-050174 | 2/2001 |
| JP | 2006-307829 | 11/2006 |
| WO | WO 2006/134588 A | 12/2006 |
| WO | WO 2007/122127 | 11/2007 |

OTHER PUBLICATIONS

Extended European Search Report dated Jan. 30, 2009 issued in corresponding EP Application No. 08159492.1-2311.

(Continued)

*Primary Examiner* — Charles Freay
*Assistant Examiner* — Christopher Bobish
(74) *Attorney, Agent, or Firm* — Nixon & Vanderhye PC

(57) ABSTRACT

A fuel pump includes a pump housing having a compression chamber. A plunger is axially movable in the pump housing for pressurizing fuel in the compression chamber. A discharge valve is configured to open to supply fuel from the compression chamber to an internal combustion engine when pressure in the compression chamber is more than predetermined pressure. A fuel passage is configured to communicate a downstream of the discharge valve with an upstream of the discharge valve. An in-passage member is accommodated in the fuel passage. The in-passage member includes multiple members, which are combined to define a throttle portion for restricting fuel, which returns from the downstream of the discharge valve to the upstream of the discharge valve.

2 Claims, 17 Drawing Sheets

OTHER PUBLICATIONS

Chinese Office Action dated May 19, 2010, issued in corresponding Chinese Application No. 200810136008.5 with English translation.
Japanese Office Action dated Apr. 28, 2009, issued in corresponding Japanese Application No. 2007-178904, with English translation.
Partial European Search Report issued in Corresponding EP Application No. 08159492.1 dated Oct. 27, 2008.
Chinese Office Action dated Nov. 3, 2010, issued in corresponding Chinese Application No. 200810136008.5 with English Translation.

* cited by examiner

FUEL PUMP FOR INTERNAL COMBUSTION ENGINE

CROSS REFERENCE TO RELATED APPLICATIONS

This application is based on and incorporates herein by reference Japanese Patent Application No. 2007-178904 filed on Jul. 6, 2007.

FIELD OF THE INVENTION

The present invention relates to a fuel pump having a plunger for pressurizing fuel in a compression chamber to supply the fuel to an internal combustion engine.

BACKGROUND OF THE INVENTION

For example, US 2006/0222538 A1 (JP-A-2006-307829) discloses a high-pressure fuel pump having a plunger for pressurizing fuel in a compression chamber and supplying the fuel to an internal combustion engine. The fuel supplied to the internal combustion engine is injected from a fuel injection valve into a combustion chamber. The high-pressure fuel pump is provided with a discharge valve. The discharge valve is provided at the downstream of a compression chamber. The discharge valve opens to supply fuel from the compression chamber to the internal combustion engine when fuel pressure in the compression chamber becomes more than predetermined pressure. The discharge valve also operates as a check valve for restricting counterflow of fuel from the fuel injection valve of the internal combustion engine to the compression chamber.

When the fuel injection valve stops fuel injection in accordance with a fuel cut operation or stoppage of the internal combustion engines the downstream of the high-pressure fuel pump is blockaded between the discharge valve and the fuel injection valve. Alternatively, in a structure where a relief valve is provided for restricting fuel pressure from abnormally increasing in the downstream of the high-pressure fuel pump, the downstream of the high-pressure fuel pump is blockaded by the relief valve when the fuel injection valve stops fuel injection. In such structures, fuel pressure in the downstream of the high-pressure fuel pump is held high. The high pressure as control pressure is applied to fuel when the fuel injection valve stops. In addition, when the internal combustion engine is sufficiently warmed up, fuel pressure may be further increased by heat transmitted from the internal combustion engine to the fuel.

In such a case, fuel pressure in the downstream of the high-pressure fuel pump, i.e., in the upstream of the fuel injection valve may be held high when the fuel injection valve closes and the internal combustion engine stops. Accordingly, fuel may leak from a valve portion of the fuel injection valve into the combustion chamber of the internal combustion engine, which is being stopped. When fuel leaks into the combustion chamber during the internal combustion engine stops, a large amount of unburnt components such as HC may be discharged with exhaust gas in restarting of the engine. The amount of fuel injected from the fuel injection valve is preferably small when fuel injection is resumed under such a fuel cut operation. However, when fuel pressure in the upstream of the fuel injection valve is high, a large amount of fuel is injected from the fuel injection valve at the time of resuming the fuel injection. Consequently, a drive train of the internal combustion engine is applied with impact caused by rapid increasing in output power of the internal combustion engine.

In the high-pressure fuel pump of US 2006/0222538 A1, the outer wall of the housing of the discharge valve or the relief valve and the mount hole of the housing therebetween define a clearance. In the present structure, fuel is returned from the downstream of the high-pressure fuel pump to a low-pressure component through the clearance when the fuel injection valve stops, whereby fuel pressure in the downstream of the high-pressure fuel pump is reduced.

Here, the function to return fuel from the downstream of the high-pressure fuel pump to a low-pressure component during the stoppage of the internal combustion engine contradicts the function of the discharge valve. Accordingly, when the amount of fuel returning to the low-pressure component is large, the high-pressure fuel pump needs to discharge additional fuel correspondingly to the amount of the return fuel. As a result, loss in driving power of the pump increases. Thus, the return fuel is preferably small.

In addition, the housing of the discharge valve or the relief valve needs a minimum diameter, since the housing has a passage for flowing fuel and accommodates components such as a valve element. Accordingly, the present structure, in which fuel returns from the downstream of the high-pressure fuel pump to the low-pressure component by utilizing the clearance between the outer wall of the housing of the discharge valve or the relief valve and the mount hole, has a limitation in reduction in passage area of the clearance. That is, it is difficult to significantly reduce the amount of fuel returning to the low-pressure component.

SUMMARY OF THE INVENTION

In view of the foregoing and other problems, it is an object of the present invention to produce a fuel pump, which is capable of restricting loss in driving power caused by returning discharged fuel.

According to one aspect of the present invention, a fuel pump for an internal combustion engine, the fuel pump comprises a pump housing having a compression chamber. The fuel pump further comprises a plunger axially movable in the pump housing for pressurizing fuel in the compression chamber. The fuel pump further comprises a discharge valve configured to open to supply fuel from the compression chamber to the internal combustion engine when pressure in the compression chamber is more than predetermined pressure. The fuel pump further comprises a fuel passage configured to communicate a downstream of the discharge valve with an upstream of the discharge valve. The fuel pump further comprises an in-passage member accommodated in the fuel passage. The in-passage member includes a plurality of members, which are combined to define a throttle portion for restricting fuel, which returns from the downstream of the discharge valve to the upstream of the discharge valve.

BRIEF DESCRIPTION OF THE DRAWINGS

The above and other objects, features and advantages of the present invention will become more apparent from the following detailed description made with reference to the accompanying drawings. In the drawings.

Figure 4:
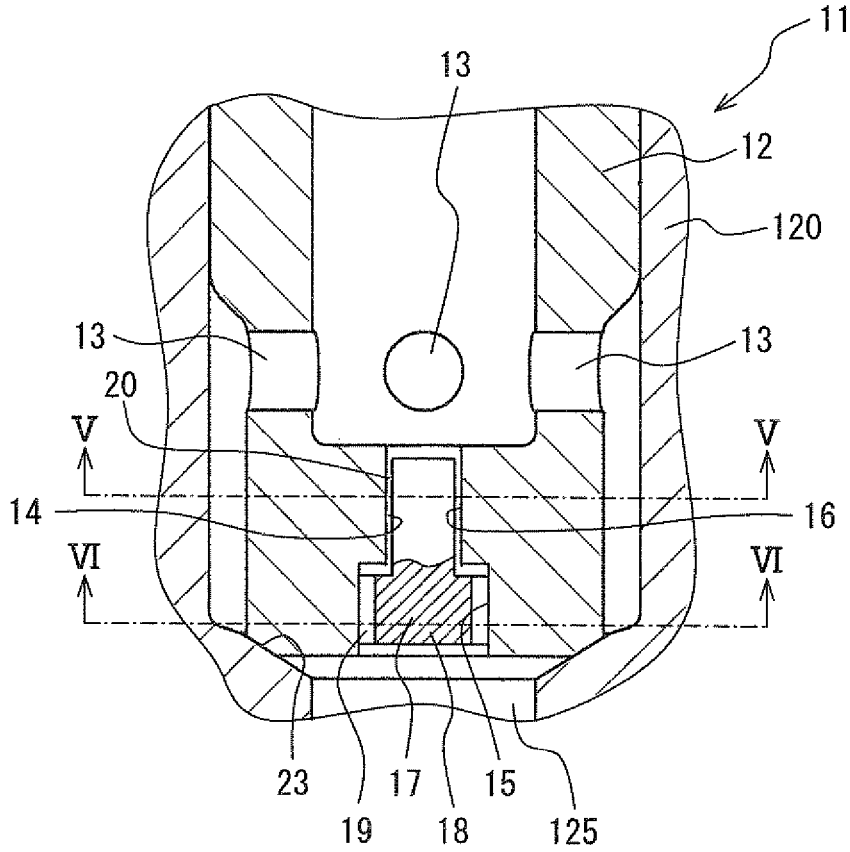
FIG. 4 is an enlarged sectional view showing a discharge valve of the high-pressure fuel pump according to the first embodiment.
Figure 7:
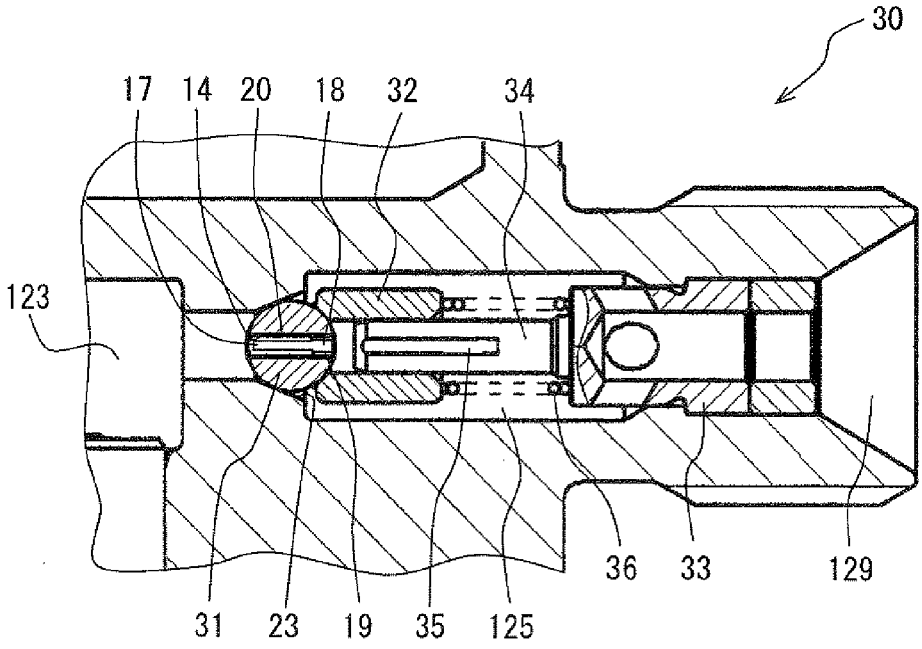
Figure 8:
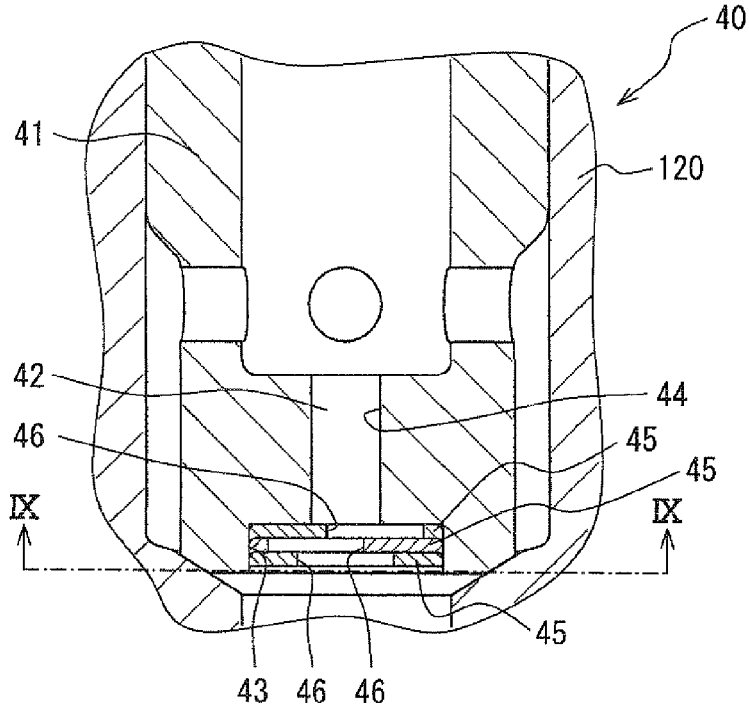
Figure 9:
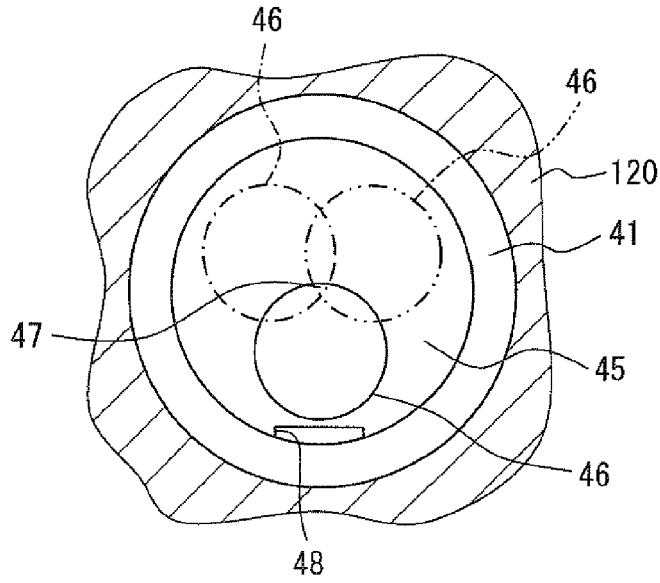
Figure 10:
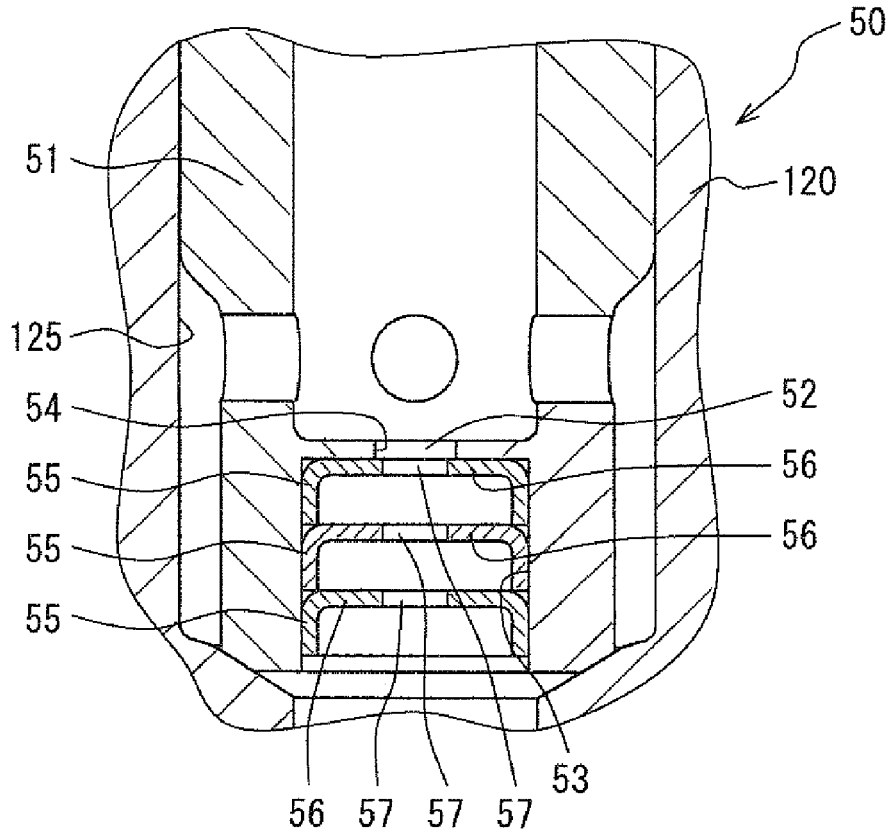
Figure 11:
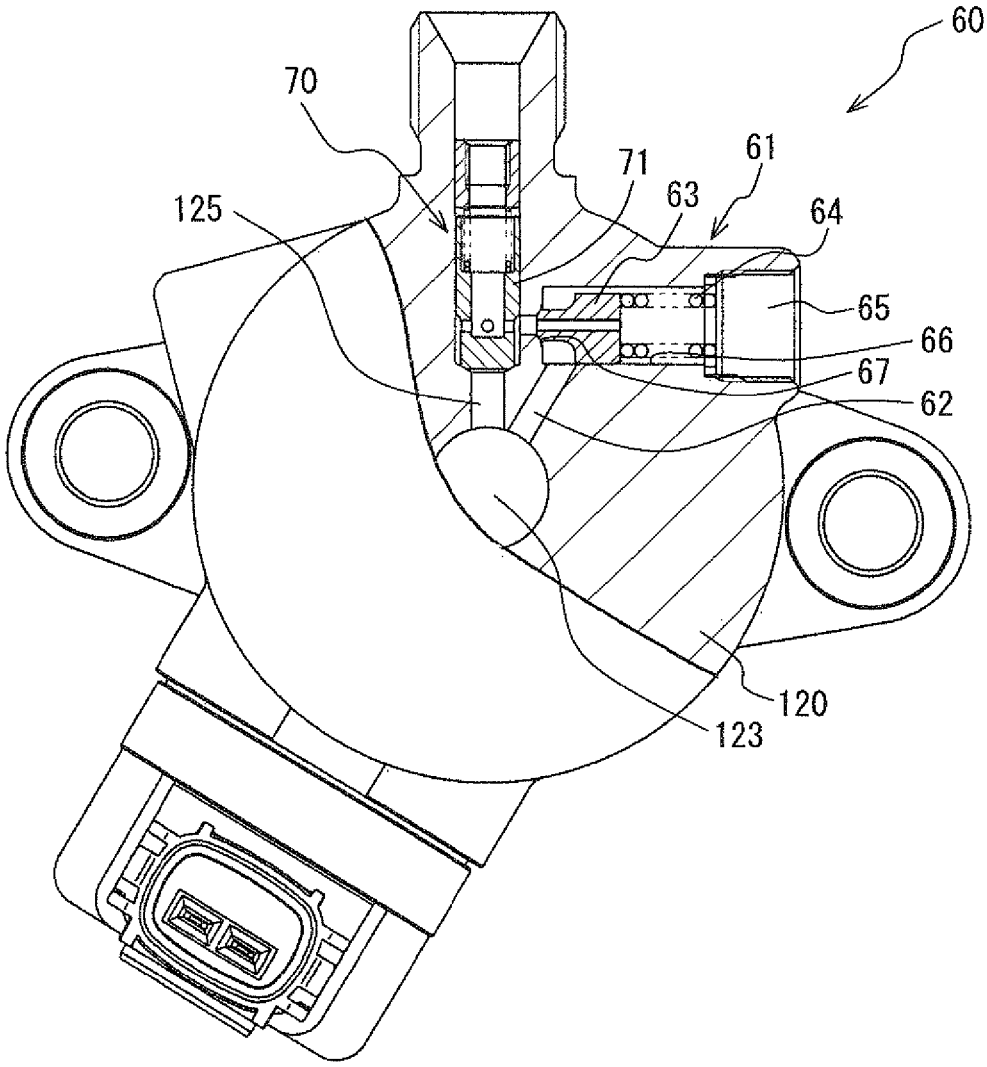
Figure 12:
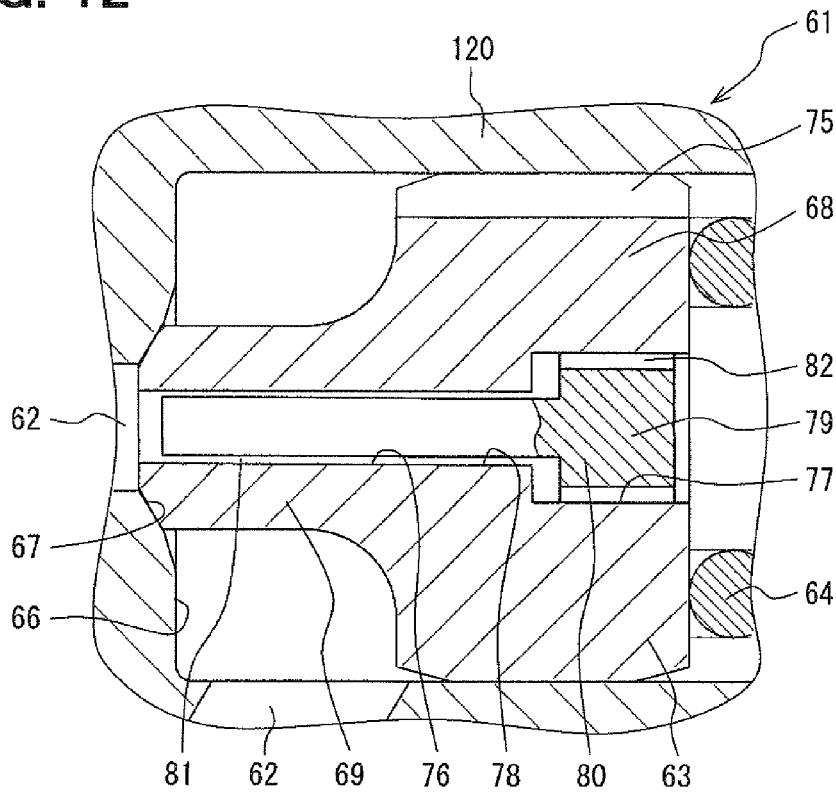
Figure 13:
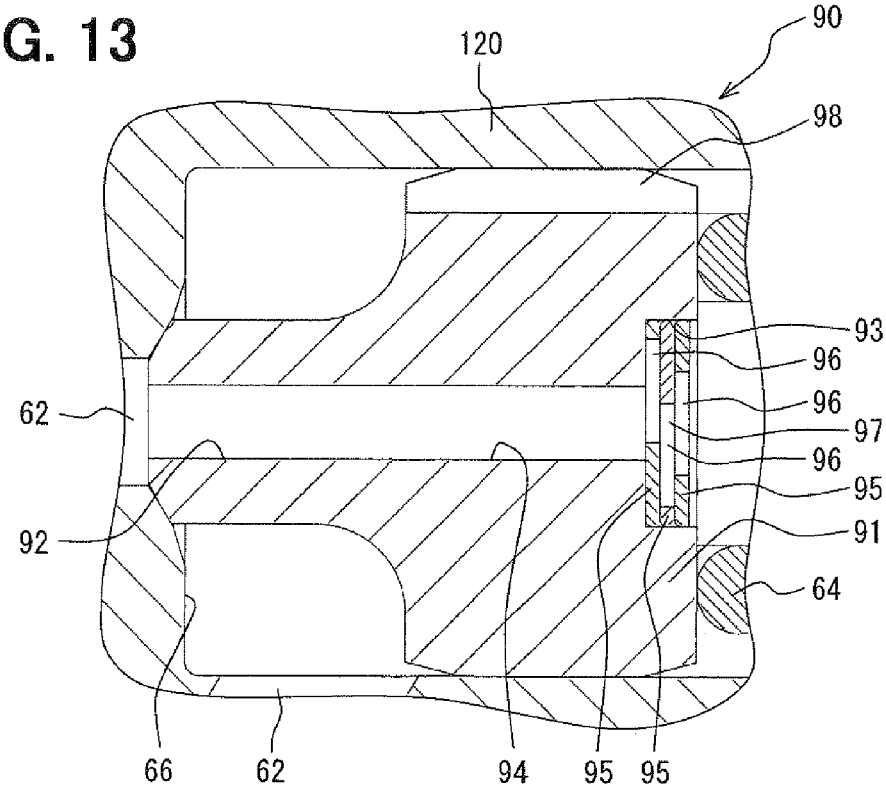
Figure 14:
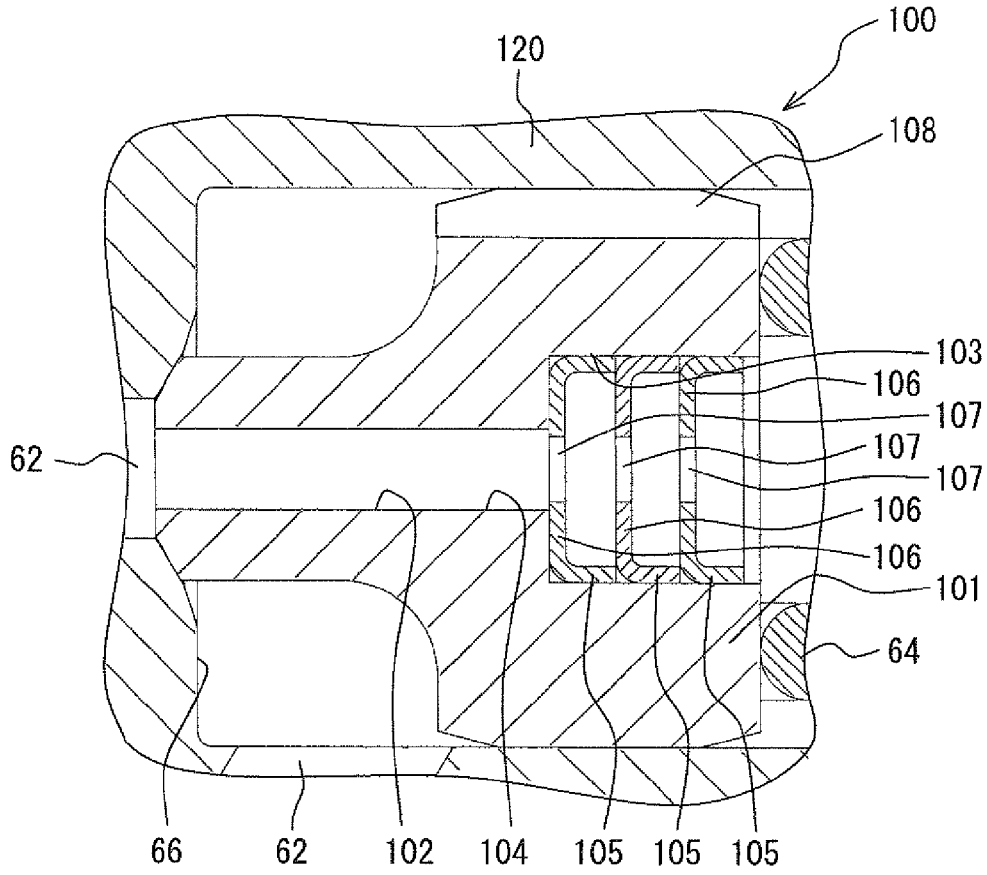
Figure 15:
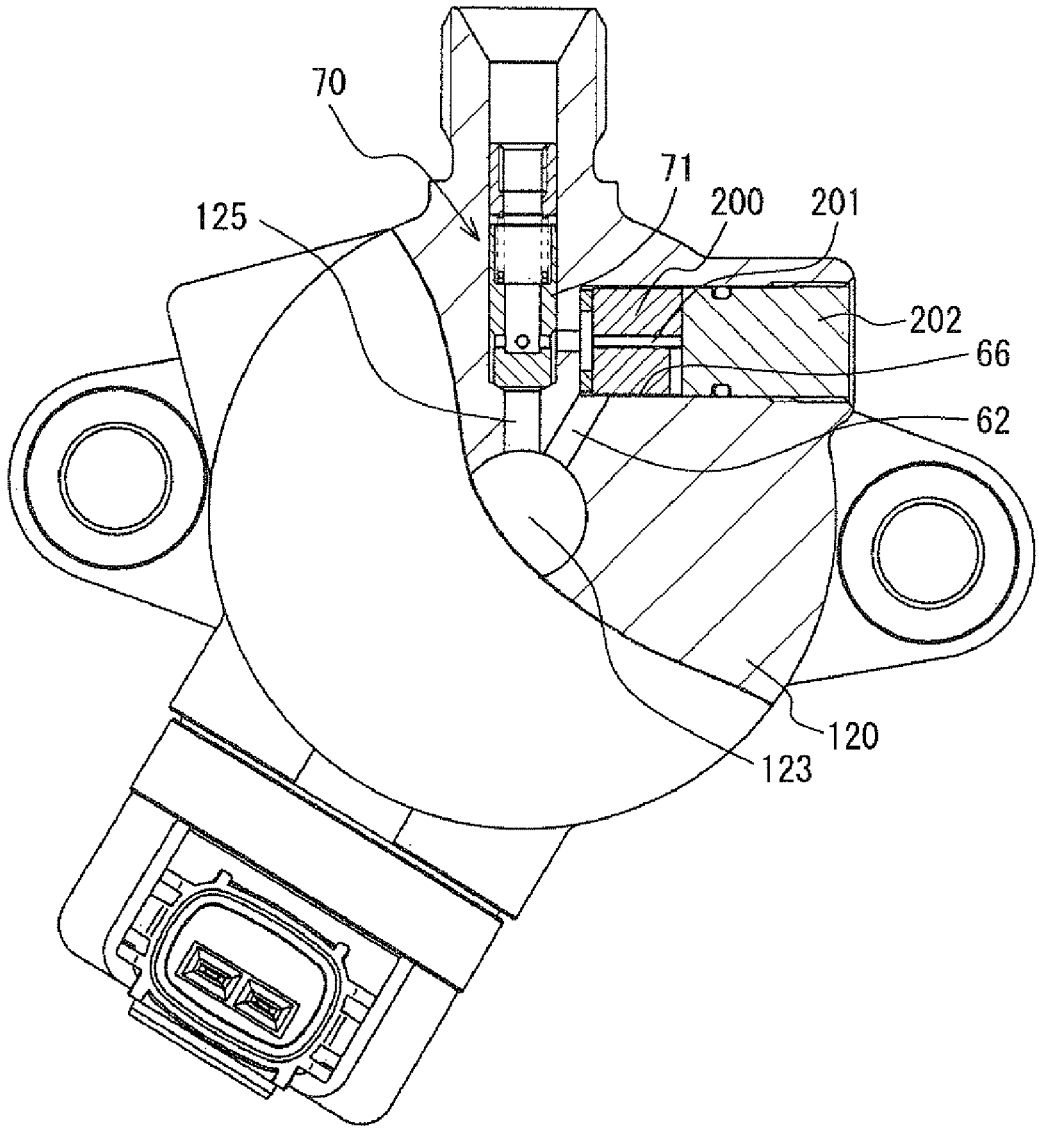
Figure 16:
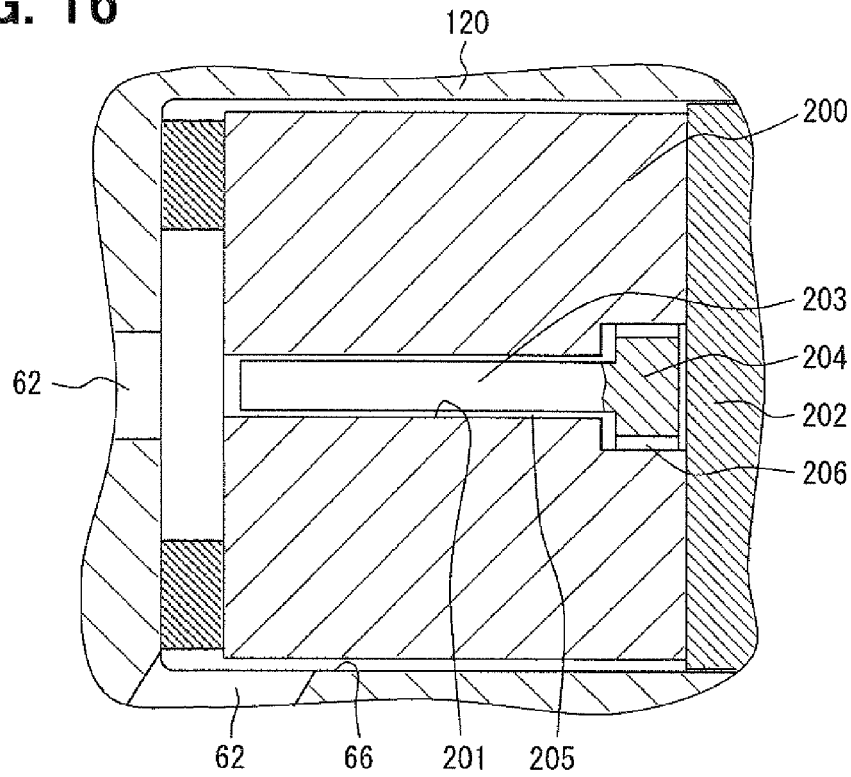
Figure 17:
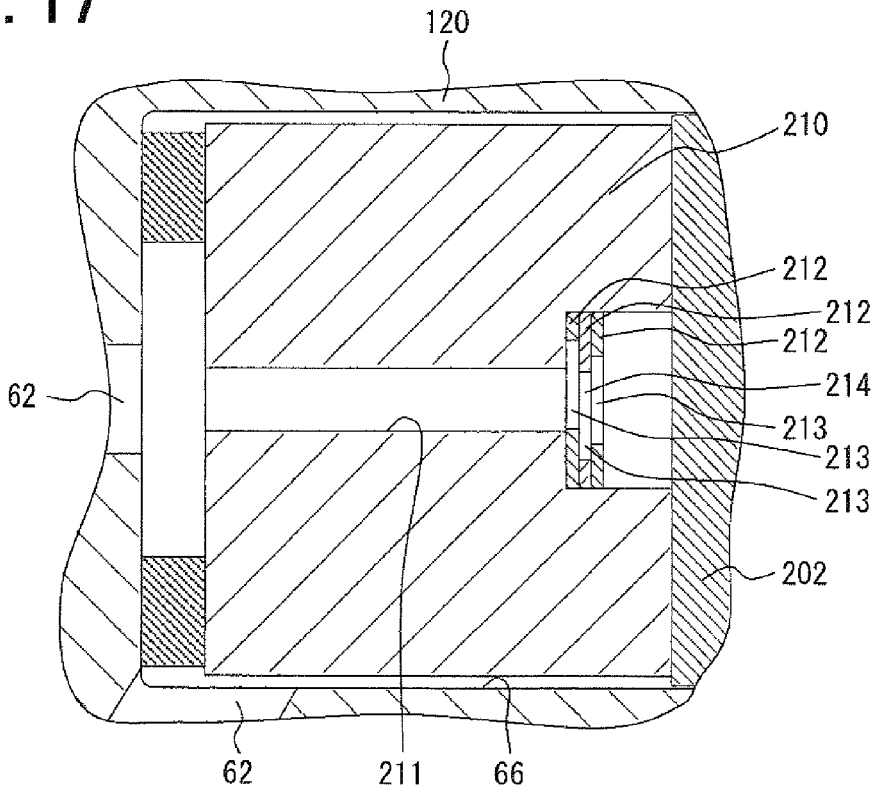
Figure 18:
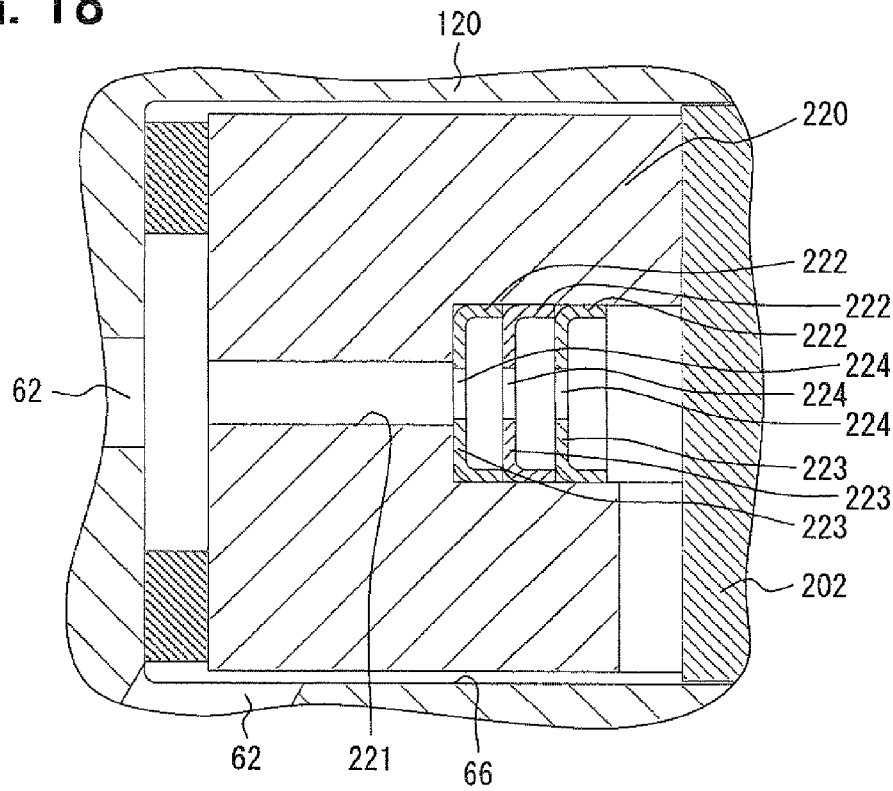
Figure 19:
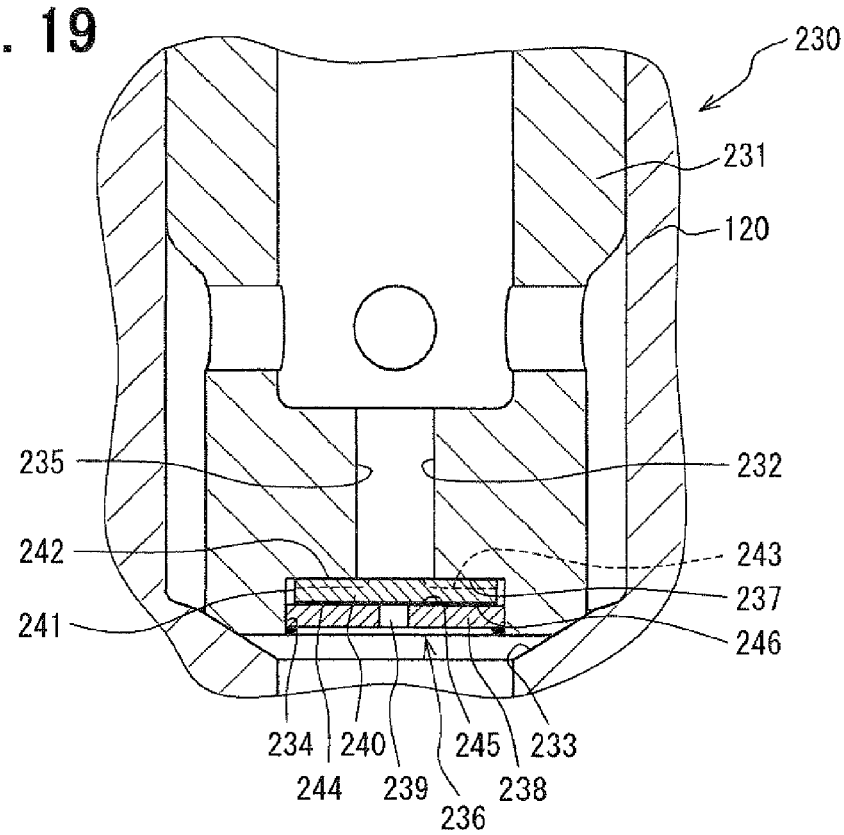
Figure 20:
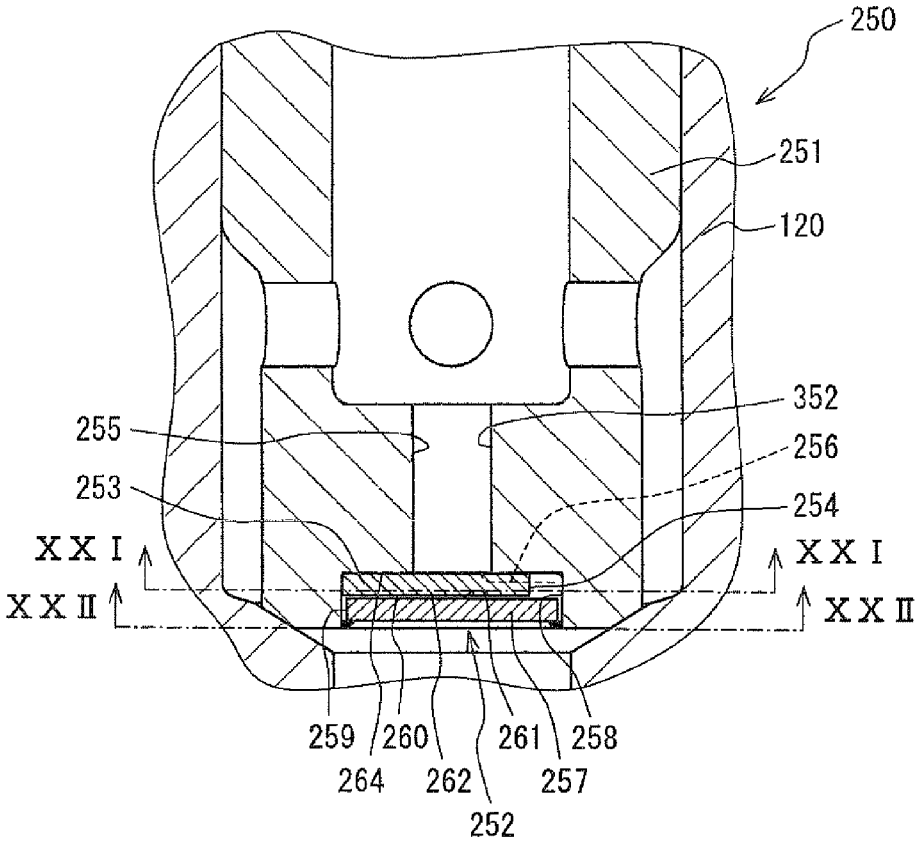
Figure 21:
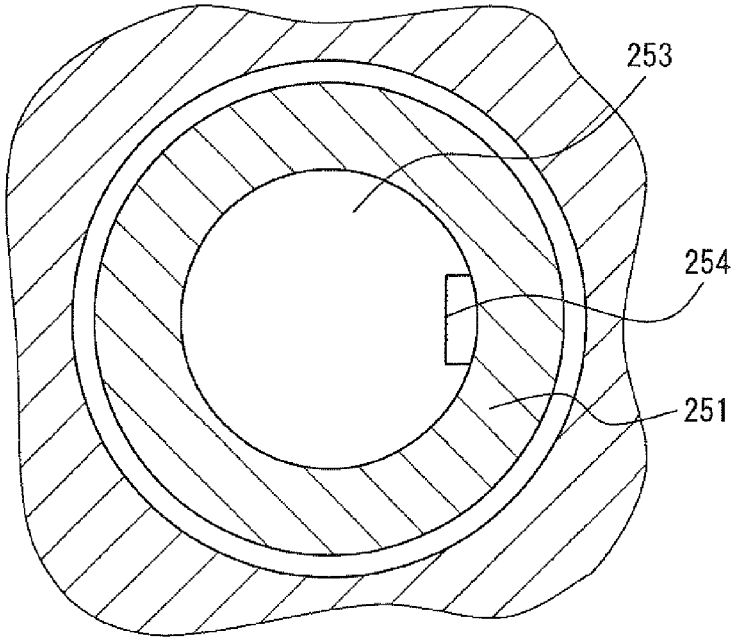
Figure 22:
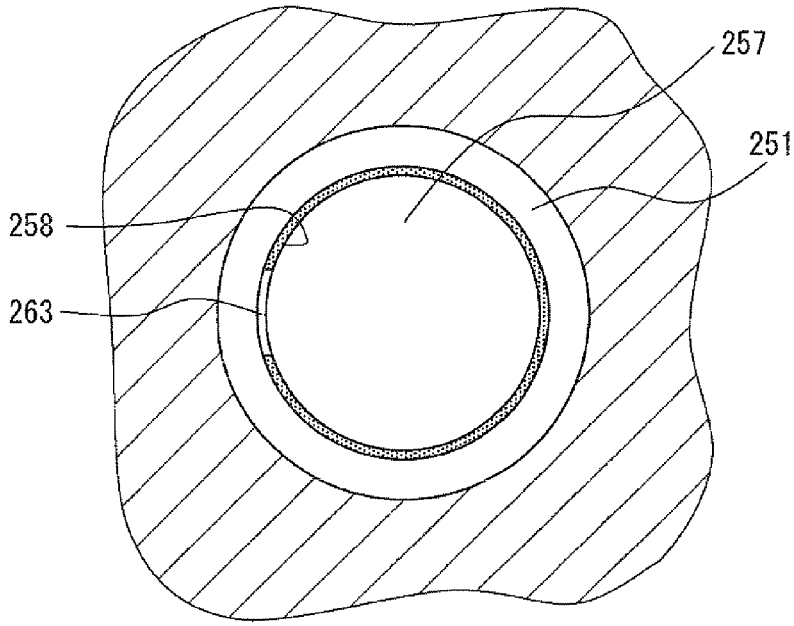
Figure 23:
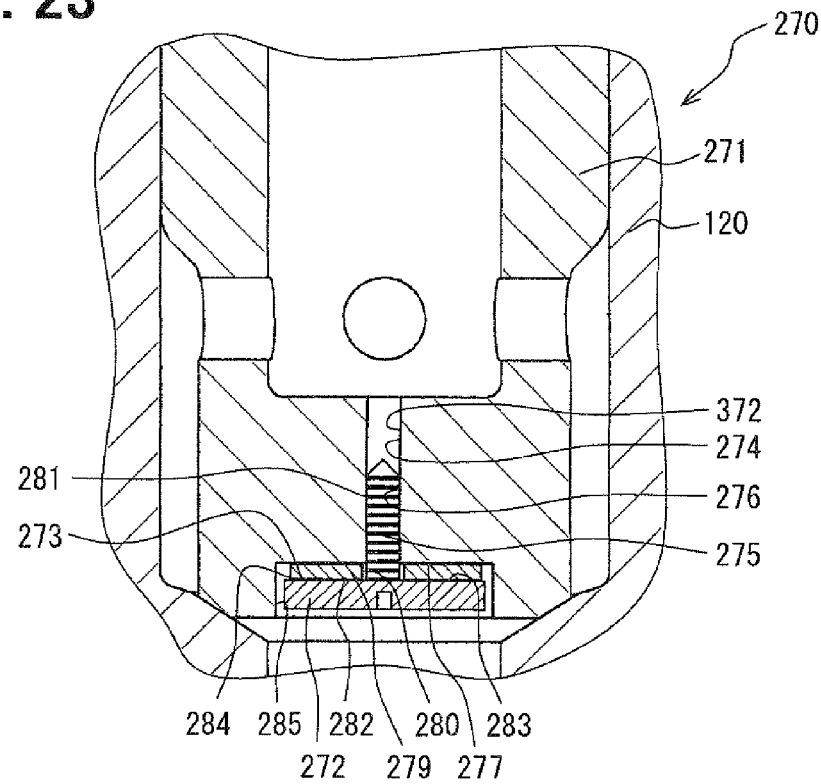
Figure 24:
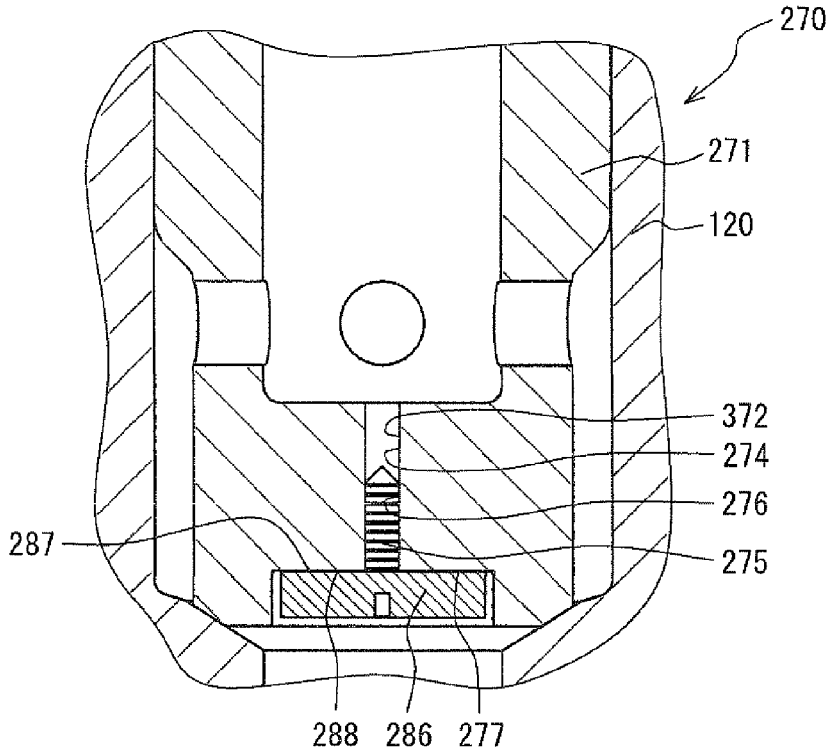
Figure 25:
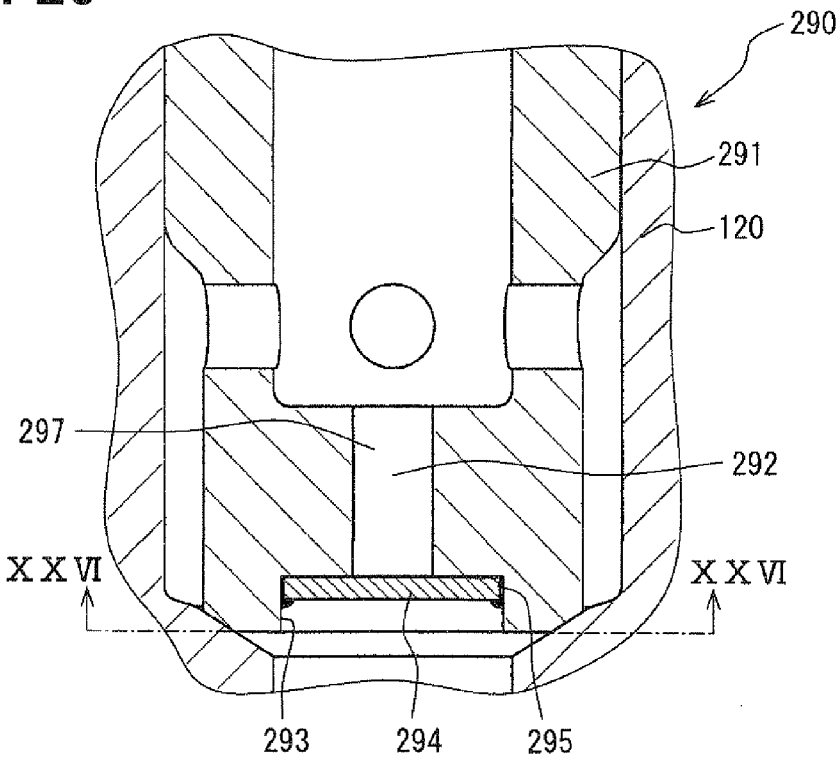
Figure 26:
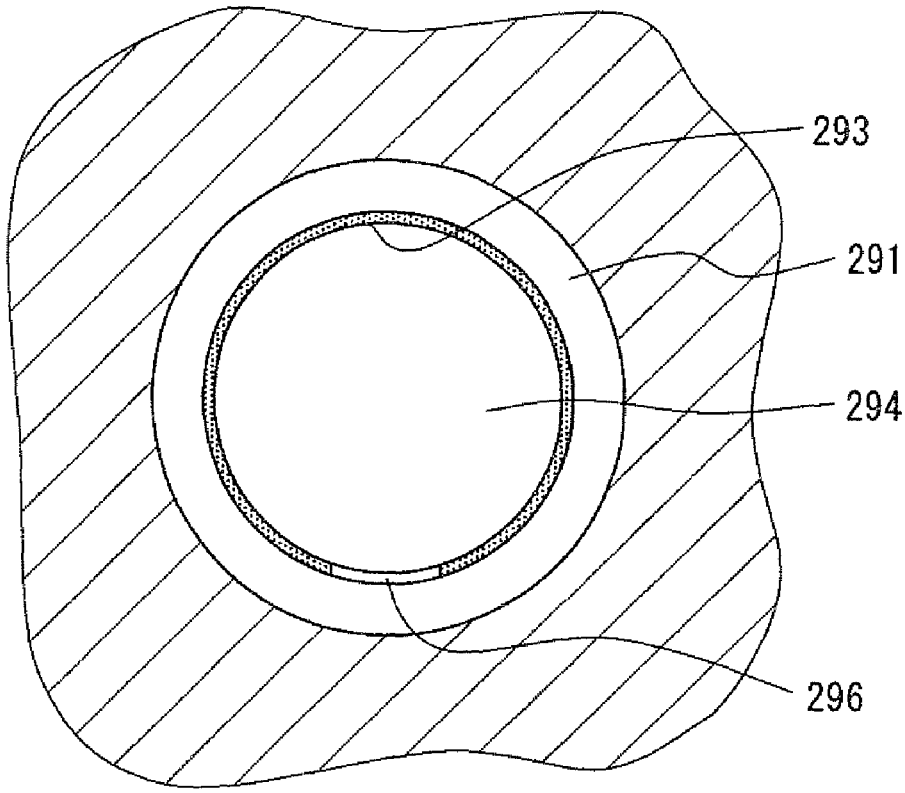

FIG, 6 is a sectional view taken along the line VI-VI in FIG. 4;

FIG. 7 is an enlarged sectional view showing a discharge valve of the high-pressure fuel pump according to a modification of the first embodiment;

FIG. 8 is an enlarged sectional view showing a discharge valve of the high-pressure fuel pump according to a second embodiment;

FIG. 9 is a sectional view taken along the line IX-IX in FIG. 8;

FIG. 10 is an enlarged sectional view showing a discharge valve of the high-pressure fuel pump according to a third embodiment;

FIG. 11 is a partially sectional view showing a high-pressure fuel pump according to a fourth embodiment;

FIG. 12 is an enlarged sectional view showing a relief valve of the high-pressure fuel pump shown in FIG. 11;

FIG. 13 is an enlarged sectional view showing a relief valve of the high-pressure fuel pump according to a fifth embodiment;

FIG. 14 is an enlarged sectional view showing a relief valve of the high-pressure fuel pump according to a sixth embodiment;

FIG. 15 is a partially sectional view showing a high-pressure fuel pump according to a seventh embodiment;

FIG. 16 is an enlarged sectional view showing a portion around an accommodation hole of the high-pressure fuel pump shown in FIG. 15;

FIG. 17 is an enlarged sectional view showing a portion around the accommodation hole of the high-pressure fuel pump according to an eighth embodiment, FIG. 18 is an enlarged sectional view showing a portion around the accommodation hole of the high-pressure fuel pump according to a ninth embodiment;

FIG. 19 is an enlarged sectional view showing a discharge valve of the high-pressure fuel pump according to a tenth embodiment;

FIG. 20 is an enlarged sectional view showing a discharge valve of the high-pressure fuel pump according to an eleventh embodiment;

FIG. 21 is a sectional view taken along the line XXI-XXI in FIG. 20;

FIG. 22 is a sectional view taken along the line XXII-XXII in FIG. 20;

FIG. 23 is an enlarged sectional view showing a discharge valve of the high-pressure fuel pump according to a twelfth embodiment;

FIG. 24 is an enlarged sectional view showing a discharge valve of the high-pressure fuel pump according to a thirteenth embodiment;

FIG. 25 is an enlarged sectional view showing a discharge valve of the high-pressure fuel pump according to a fourteenth embodiment; and FIG. 26 is a sectional view taken along the line XXVI-XXVI in FIG. 25.

DETAILED DESCRIPTION OF PREFERRED EMBODIMENTS

First Embodiment

Figure 1:
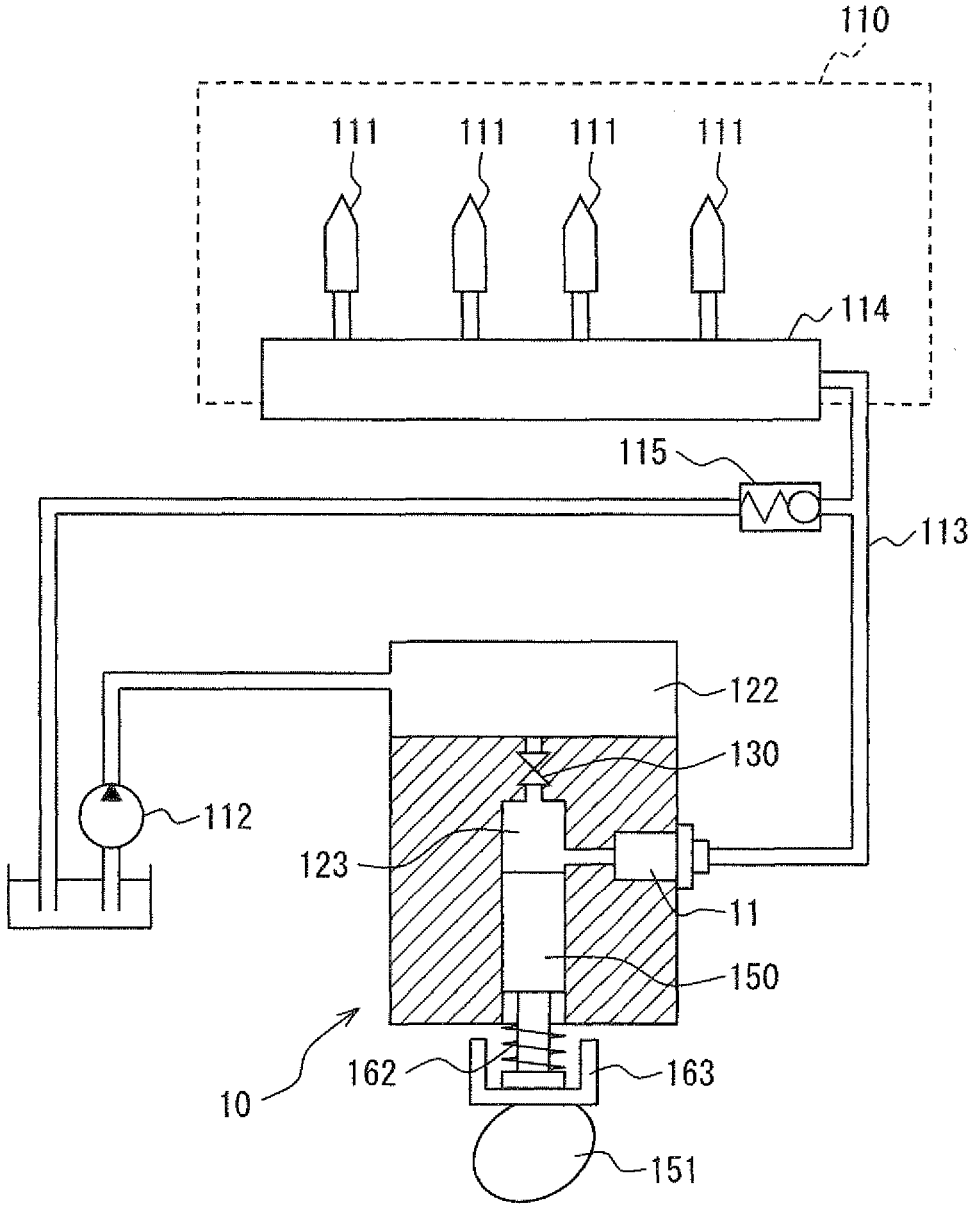
FIG. 1 is a schematic view showing a fuel supply system, which includes a high-pressure fuel pump, according to a first embodiments

As shown in FIG. 1, a fuel feed system is a gasoline direct injection system for injecting fuel directly into a cylinder of a gasoline engine. A High-pressure fuel pump 10 is configured to supply fuel into a fuel injection valve 111.

A metering valve 130, which has a solenoid actuator, intermits communication between a suction chamber 122 and a compression chamber 123 in the high-pressure fuel pump 10. The suction chamber 122 is supplied with fuel from a low-pressure fuel pump 112. A plunger 150 moves back and forth with rotation of a cam 151 thereby to pressurize fuel drawn into the compression chamber 123. Fuel is pressurized in the compression chamber 123 and is supplied from a discharge valve 11 to a delivery pipe 114 after passing through a fuel pipe 113, which is located downstream of the high-pressure fuel pump 10. The fuel injection valve 111 is attached to the delivery pipe 114 for injecting fuel, which is accumulated in the delivery pipe 114, into the combustion chamber of an internal combustion engine 110. A relief valve 115 is attached to the fuel pipe 113, which is located downstream of the high-pressure fuel pump 10. The relief valve 115 is configured to restrict fuel at the downstream of the high-pressure fuel pump 10 from abnormally increasing in pressure.

Next, the structure of the high-pressure fuel pump 10 is described in detail with reference to FIGS. 2 to 6. The high-pressure fuel pump 10 includes a cylinder 120, a housing cover 121, the plunger 150, the metering valve 130, the discharge valve 11, and the like.

The cylinder 120 and the housing cover 121 construct a pump housing. The cylinder 120 is formed from a magnetic material such as martensitic stainless steel or the like. The cylinder 120 supports the plunger 150, which is axially movable in the cylinder 120. The cylinder 120 has a slidable portion 126, on which the plunger 150 is slidable. The slidable portion 126 is hardened by being applied with high frequency quenching or the like. The cylinder 120 has a fuel inlet, which is provided with a pipe joint (not shown) and the metering valve 130. The pipe joint is connected with the low-pressure fuel pump 112. The cylinder 120 has a fuel outlet, which is provided with the discharge valve 11.

The cylinder 120 is provided with an intake passage 124, the compression chamber 123, a discharge passage 125, and the like. The suction chamber 122 is defined between the cylinder 120 and the housing cover 121. The discharge passage 125 has a fuel outlet, which is provided with an outlet portion 129.

The plunger 150 is supported by the slidable portion 126 of the cylinder 120 and axially movable on the slidable portion 126 of the cylinder 120. The compression chamber 123 is provided on one-end of the plunger 150 with respect to the move direction of the plunger 150. A head 160 is provided to the other end of the plunger 150. The head 160 is connected with a spring seat 161. A spring 162 is provided between the spring seat 161 and the cylinder 120.

The spring seat 161 is biased onto the inner periphery of the bottom wall of a tappet 163 (FIG. 1) by biasing force of the spring 162. Sliding of the outer periphery of the bottom wall of the tappet 163 relative to the cam 151 is accompanied with rotation of the cam 151. The plunger 150 axially moves in conjunction with the rotation of the cam 151.

The outer circumferential periphery of the plunger 150 at the side of the head 160 and the inner circumferential periphery of the cylinder 120, which accommodates the plunger 150, are therebetween sealed with an oil seal 164. The oil seal 164 restricts intrusion of oil from the inside of the engine 110 into the compression chamber 123. An oil seal 28 also restricts leakage of fuel from the compression chamber 123 into the engine 110. Fuel leaking from the slidable portion between the plunger 150 and the cylinder 120 to the oil seal 164 is returned from a releasing passage (not shown) to an introduction passage (not shown). The introduction passage connects a pipe joint on a side of a low-pressure component with a suction chamber. In the present structure, the oil seal 164 is restricted from being applied with high pressure of fuel.

Figure 2:
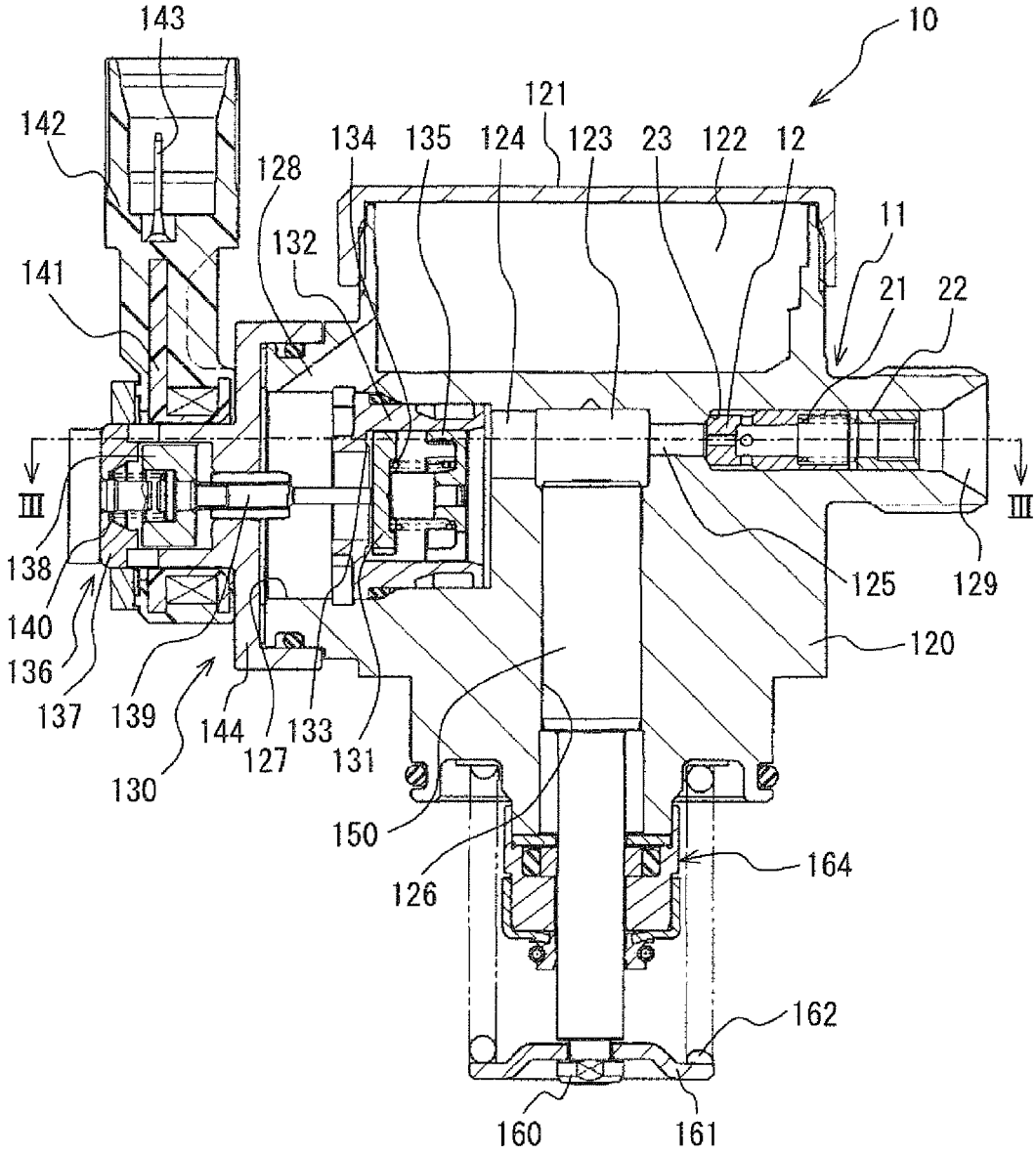
FIG. 2 is a partially sectional lateral view showing the high-pressure fuel pump according to the first embodiment.
Figure 3:
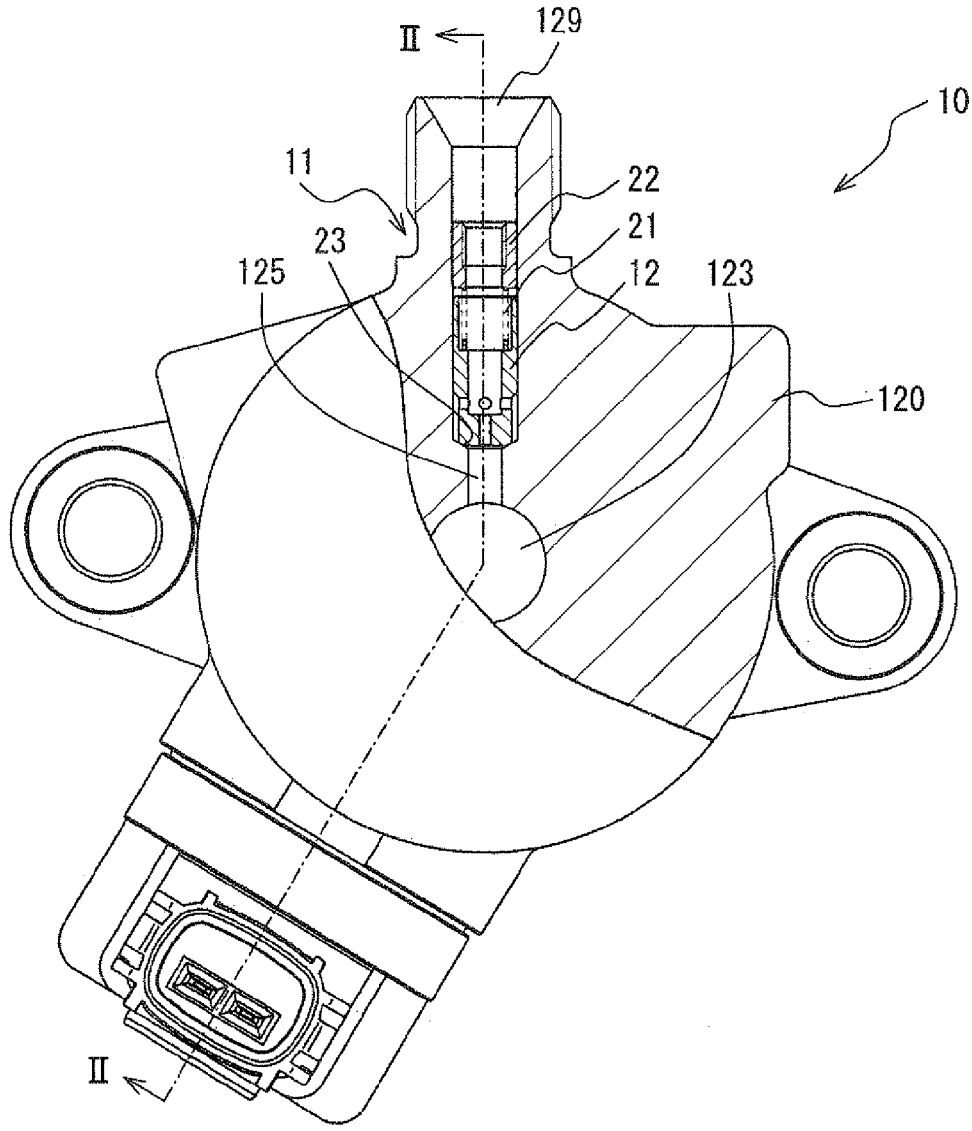
FIG. 3 is a partially sectional view taken along a line III-III in FIG. 2.

FIG. 2 is a partially sectional view, which is taken along the line II-II in FIG. 3, showing the high-pressure fuel pump 10 according to the first embodiment. As shown in FIG. 2, the metering valve 130 includes a valve element 131, a guide 132, a spring 134, which is for closing the metering valve 130, a spring seat 135, a solenoid actuator 136, and the like. The valve element 131, the guide 132, the spring 134, and the spring seat 135 are accommodated in an accommodation hole 127, which is provided in the cylinder 120. The intake passage 124 opens at the bottom portion of the accommodation hole 127. A communication passage 128 opens on the sidewall of the accommodation hole 127. The communication passage 128 communicates the accommodation hole 127 with the suction chamber 122. The valve element 131 is in a plate shape and guided by the guide 132, which is in a substantially cylindrical shape, such that the valve element 131 is axially movable. The guide 132 has a valve seat portion 133 at the side of the communication passage 128. The spring 134 is supported by the valve element 131 at one end and is supported by the spring seat 135 at the other end. The spring 134 biases the valve element 131 toward the valve seat portion 133. When the valve element 131 is seated to the valve seat portion 133, the suction chamber 122 is blockaded from the intake passage 124.

The solenoid actuator 136 of the metering valve 130 includes a stationary core 137, a movable core 138, a pin 139, a spring 140, which is for opening the metering valve 130, a coil portion 141, a connector portion 142, a body 144, and the like. The body 144 closes the accommodation hole 127, which is provided on the lateral side of the cylinder 120. The movable core 138 is guided to be axially movable on the inner wall of the body 144. The stationary core 137 is provided to the end of the body 144. The movable core 138 is formed from a magnetic material and provided with the pin 139 at a side of the accommodation hole 127. The tip end of the pin 139 is in contact with the valve element 131. The movable core 138 has an end, which is on the opposite side of the pin 139, and the end of the movable core 138 and the stationary core 137 therebetween interpose the spring 140. The spring 140 biases the movable core 138 toward the valve element 131. That is, the spring 140 biases the valve element 131 to lift the valve element 131 from the valve seat portion 133.

The coil portion 141 is provided radially outside of the body 144, and the connector portion 142 is further provided radially outside of the coil portion 141. The coil portion 141 is accommodated in the connector portion 142 by being insert-molded therein. A terminal 143 is provided in the connector portion 142 to supply electric power to a coil, which is formed by winding an electric wire around the coil portion 141.

Here, the biasing force of the spring 140 is larger than the biasing force of the spring 134. Therefore, in the state where electric power is not supplied to the coil portion 141, the movable core 138 is moved toward the valve element 131. Accordingly, the valve element 131 is opened, and the suction chamber 122 is communicated with the intake passage 124.

When the coil portion 141 is supplied with electric power through the terminal 143, the coil portion 141 of the stationary core 137 generates magnetic attractive force to attract the movable core 138 toward the spring 140. Then, the movable core 138 moves toward the spring 140 against the biasing force of the spring 140. Therefore, the valve element 131 is seated to the valve seat portion 133, and hence the suction chamber 122 is blockaded from the intake passage 124.

As shown in FIGS. 2, 3, the discharge valve 11 defines a fuel outlet of the high-pressure fuel pump 10. The discharge valve 11 is fitted into the discharge passage 125, which is provided in the cylinder 120. The discharge passage 125 accommodates a valve element 12, a spring 21, and a stopper 22. In the present embodiment, the discharge valve 11, which includes the above components, is fitted into the discharge passage 125 of the cylinder 120. Alternatively, the above components may be fitted into a body as a separate component from the cylinder 120, and the body may be connected with the discharge passage 125.

The discharge passage 125 has a valve seat portion 23, to which the valve element 12 is seated. The valve element 12 is located closer to the outlet portion 129 than the valve seat portion 23. The valve element 12 is seated to the valve seat portion 23 when moving toward the compression chamber 123.

The spring 21 is provided to be closer to the outlet portion 129 than the end of the valve element 12. The spring 21 is supported by the valve element 12 at one end. The spring 21 is further supported by the stopper 22, which is in a substantially cylindrical shape so as to regulate the movement of the valve element 12. The spring 21 regularly biases the valve element 12 toward the valve seat portion 23. When differential pressure occurs to the valve element 12 at the side of the compression chamber 123 relative to the side of the outlet portion 129 thereby to exert force, which is larger than the biasing force of the spring 21, to the valve element 12, the valve element 12 is lifted from the valve seat portion 23. In this case, the valve element 12 moves to make contact with the stopper 22. When the valve element 12 is lifted from the valve seat portion 23, the compression chamber 123 is communicated with the outlet portion 129.

Referring to FIGS. 2, 3, the stopper 22 is fixed to the discharge passage 125 by, for example, being press-fitted into the discharge passage 125. The movement of the valve element 12 and the load exerted by the spring 21 can be controlled by adjusting the position of the stopper 22 inside the discharge passage 125.

As shown in FIG. 4, the valve element 12 is in the shape of a cup. The cup-shaped valve element 12 has a bottom portion, which is directed to the compression chamber 123, and an opening end, which is directed to the outlet portion 129, in the discharge passage 125. The outer diameter of the bottom portion of the valve element 12 is smaller than the outer diameter of the opening end of the valve element 12. The outer diameter of the opening end is substantially the same as the inner diameter of the discharge passage 125, whereby the valve element 12 is axially movable by being guided at the opening end (FIGS. 2, 3). The spring 21 is supported by the opening end of the valve element 12 at the one end.

The bottom portion of the valve element 12 has the outer diameter, which is smaller than the inner diameter of the discharge passage 125. Therefore, the inner wall of the discharge passage 125 and the outer wall of the valve element 12 therebetween define an annular space. The bottom portion of the valve element 12 and the opening end of the valve element 12 therebetween define multiple communication holes 13, which communicate the annular space with the inside of the valve element 12.

As shown in FIG. 4, the bottom portion of the valve element 12 has a passage 14, which communicates the inside of the valve element 12 with the outer wall surface of the bottom portion of the valve element 12. The passage 14 regularly communicates the compression chamber 123 with the outlet portion 129, even in the state where the valve element 12 is seated to the valve seat portion 23. The valve element 12 is equivalent to one of two in-passage members, and the passage 14 is equivalent to a first passage.

The passage 14 has a large-diameter passage portion 15 at the side of the compression chamber 123. The passage 14 further has a small-diameter passage portion 16 at the side of the outlet portion 129. A bar-shaped pin 17 is accommodated in the passage 14. The pin 17 has a press-fitted portion 18 at one end, and the press-fitted portion 18 can be press-fitted into the large-diameter passage portion 15. The pin 17 is equivalent to the other member of the two in-passage members. The pin 17 is also equivalent to a bar member.

Figure 5:
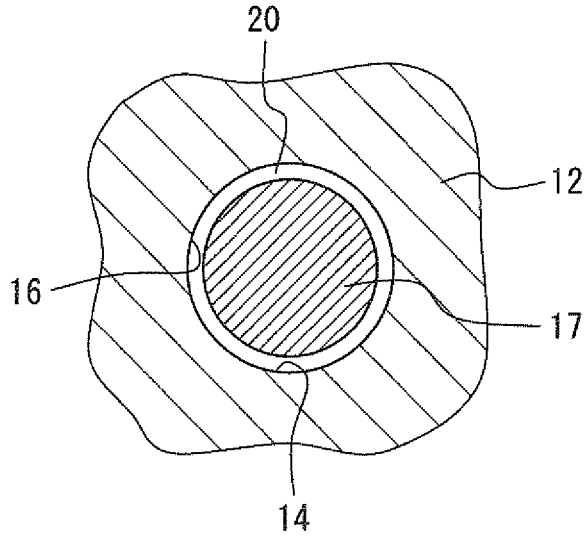
FIG. 5 is a sectional view taken along the line V-V in FIG. 4.

As shown in FIG. 5, a small clearance 20 is defined between the outer wall of the pin 17 and the inner wall of the small-diameter passage portion 16 by press-fitting the press-fitted portion 18 of the pin 17 into the large-diameter passage portion 15 whereby the pin 17 is fixed in the passage 14. The size of the clearance 20 is determined in accordance with the relationship between the inner diameter of the small-diameter passage portion 16 and the outer diameter of the pin 17.

In the present embodiment, the press-fitted portion 18 of the pin 17 is press-fitted to the large-diameter passage portion 15, whereby the pin 17 is fixed in the passage 14. Therefore, the pin 17 can be stabilized in the passage 14.

Figure 6:
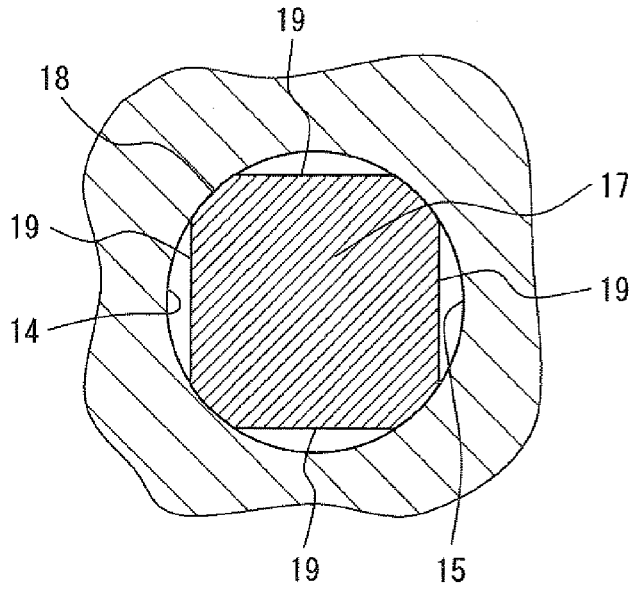

As shown in FIG. 6, the press-fitted portion 18 has a notch portion 19, which communicates the inlet of the passage 14 with the outlet of the passage 14. Therefore, the downstream of the discharge valve 11 communicates with the upstream of the discharge valve 11 through the clearance 20 and the notch portion 19.

As follows, an operation of the high-pressure fuel pump is described.

(1) Suction Stroke

When the plunger 150 moves downward and pressure in the compression chamber 123 decreases, differential pressure applied from the suction chamber 122 and the compression chamber 123 to the valve element 131 changes. The suction chamber 122 is located upstream of the valve element 131, and the compression chamber 123 is located downstream of the valve element 131. In the present condition, the resultant force exerted in the direction in which the valve element 131 is seated to the valve seat portion 133 is smaller than the resultant force exerted in the direction in which the valve element 131 is lifted from the valve seat portion 133. Therefore, the valve element 131 is lifted from the valve seat portion 133. Specifically, the resultant force caused by the fuel pressure in the compression chamber 123 and the biasing force of the spring 134 is smaller than the resultant force caused by the fuel pressure in the suction chamber 122 and the biasing force of the spring 140, therefore the valve element 131 is lifted from the valve seat portion 133. Whereby, fuel is drawn from the suction chamber 122 to the compression chamber 123 through the communication passage 128, the accommodation hole 127, and the intake passage 124.

(2) Return Stroke

Even when the plunger 150 moves upward from the bottom dead center to the top dead center, the valve element 131 is still held at the open position. In the present condition, fuel is pressurized in the compression chamber 123 by the movement of the plunger 150, and the pressurized fuel is returned from the intake passage 124 into the suction chamber 122 through the metering valve 130, the accommodation hole 127, and the communication passage 128.

(3) Press-Feed Stroke

When the coil portion 141 is energized in the return stroke, the stationary core 137 generates magnetic attractive force to draw the movable core 138 toward the spring 140. In the present condition, the resultant force exerted in the direction in which the valve element 131 is seated to the valve seat portion 133 is larger than the resultant force exerted in the direction in which the valve element 131 is lifted from the valve seat portion 133. Therefore, the valve element 131 is seated to the valve seat portion 133. Specifically, the resultant force caused by the fuel pressure in the compression chamber 123 and the biasing force of the spring 134 is larger than the resultant force caused by the fuel pressure in the suction chamber 122 and the biasing force of the spring 134, therefore the valve element 131 is seated from the valve seat portion 133. Accordingly, the suction chamber 122 is blockaded from the intake passage 124.

In the present state, when the plunger 150 further moves upward to the top dead center, fuel in the compression chamber 123 is further pressurized, whereby the fuel pressure in the compression chamber 123 increases. When the fuel pressure in the compression chamber 123 becomes greater than predetermined pressure, the valve element 12 of the discharge valve 11 is lifted from the valve seat portion 23 against the biasing force of the spring 21, whereby the discharge valve 11 is opened. In the present condition, fuel, which is pressurized in the compression chamber 123, is discharged from the outlet portion 129. The fuel, which is discharged from the outlet portion 129, is supplied to the delivery pipe 114 shown in FIG. 1, and the fuel at high pressure is accumulated in the delivery pipe 114. Thereafter, the accumulated fuel is supplied from the delivery pipe 114 to the fuel injection valve 111.

The high-pressure fuel pump 10 pumps fuel by repeating the suction stroke, the return stroke, and the press-feed stroke. The metering valve 130 controls the amount of fuel discharged from the high-pressure fuel pump 10 by controlling the timing of energizing the coil portion 141 of the metering valve 130.

The downstream of the valve element 12 of the discharge valve 11 at the side of the outlet portion 129 communicates with the upstream of the valve element 12 at the side of the compression chamber 123 through the clearance 20 and the notch portion 19 of the pin 17. The clearance 20 is defined between the inner wall of the passage 14 of the valve element 12 and the outer wall of the pin 17. In the present structure, fuel between the discharge valve 11 and the delivery pipe 114 regularly returns to the upstream of the discharge valve 11 through the clearance 20, in the state where the upstream of the discharge valve 11 is lower than the downstream of the discharge valve 11 in pressure.

Consequently, for example, when the fuel injection valve 111 stops fuel injection in response to fuel cut under an operation of the internal combustion engine 110, the fuel pressure downstream of the high-pressure fuel pump 10 decreases. That is, in the present state, the fuel pressure upstream of the fuel injection valve 111 decreases. In the present structure, when the fuel injection valve 111 resumes operation, the fuel quantity injected from the fuel injection valve 111 can be reduced to be significantly small, which is suitable for the operating condition. Consequently, the output power of the internal combustion engine 110 can be restricted from rapidly increasing, whereby the drive train of the internal combustion engine 110 can be protected from application of an impact.

Furthermore, when the fuel injection valve 111 stops fuel injection in response to, for example, stoppage of the internal combustion engine 110, the fuel pressure upstream of the fuel injection valve 111 can be decreased. Therefore leakage of fuel from the valve portion of the fuel injection valve 111 to the combustion chamber of the internal combustion engine 110 can be suppressed. In the present structure, unburnt components such as HC in exhaust gas can be reduced when the internal combustion engine 110 is restarted.

In the present embodiment, the above effect can be produced by communicating the downstream of the discharge valve 11 with the upstream of the discharge valve 11 so as to return the fuel from the downstream to the upstream. However, when the amount of fuel returned from the downstream to the upstream, the high-pressure fuel pump 10 needs to additionally discharge fuel by the amount equivalent to the returned fuel. Accordingly, the amount of fuel returned to the upstream of the discharge valve 11 is preferably small as much as possible.

According to the present embodiment, the valve element 12 has the passage 14, and the passage 14 accommodates the pin 17, whereby the clearance 20 is defined. Thus, the amount of fuel returned to the upstream of the discharge valve 11 is reduced as much as possible. The clearance 20 as a throttle portion is configured to restrict the amount of returned fuel.

In the present embodiment, the clearance 20 is inside of the valve element 12. Accordingly, the passage area of the clearance 20 can be made small as much as possible, whereby the amount of the returned fuel can be reduced as much as possible.

Here, it may be conceived to form a microscopic hole, which is equivalent to the throttle portion having a small passage area, without accommodating the pin 17 in the passage 14. Specifically, it is conceived that the microscopic hole is formed in the valve element 12 to define a channel equivalent to the passage 14 having a significantly small diameter In this case, the microscopic hole may produce an effect, similarly to the present embodiment. However, the minimum size of such a microscopic hole is limited, and therefore reduction in manufacturable passage area is also limited.

In the present embodiment, the clearance 20 is defined between the valve element 12, which has the passage 14, and the pin 17, which is accommodated in the passage 14. Therefore, the passage area can be further reduced by defining the clearance 20 than manufacturing the microscopic hole.

Specifically the clearance 20 is defined by determining the positions of both the inner wall of the passage 14 and the outer wall of the pin 17. The clearance 20 can be significantly set small by defining the inner diameter of the passage 14 and the outer diameter of the pin 17.

Both the inner diameter of the passage 14 and the outer diameter of the pin 17 are larger than the diameter of the microscopic hole. Therefore, accuracy of dimension of the clearance 20 between the passage 14 and the pin 17 can be easily enhanced.

Consequently, in the present structure, the high-pressure fuel pump 10 is capable of significantly maintaining driving power of the high-pressure fuel pump 10, while reducing pressure at the downstream of the discharge valve 11 by returning fuel from the downstream to the upstream.

In addition, the length of the clearance 20 can be arbitrary set by adjusting the shaft length of the clearance 20. Flow resistance of fuel can be controlled in dependence upon the length of the clearance 20; therefore, the fuel flow can be easily controlled.

The inner wall of the passage 14 may be tightly in contact with the outer wall of the pin 17. In this case, the coarseness of the surface of one of the inner wall of the passage 14 and the outer wall of the pin 17 is differed from the coarseness of the surface of the other one, whereby fuel can be returned from the downstream of the discharge valve 11 to the upstream. The more the coarseness is enlarged, the more the fuel return increases. According to the present structure, the returned fuel can be significantly reduced to be smaller than that in the structure in which the throttle portion is defined by manufacturing the microscopic hole.

Furthermore, in the present embodiment, the discharge passage 125, which accommodates the valve element 12 of the discharge valve 11, is used as a fuel passage to communicate the downstream of the discharge valve 11 with the upstream. Therefore, an additional passage need not be provided in the cylinder 120. Thus, the number of the components can be significantly reduced.

Modification of First Embodiment

As shown in FIG. 7, according to the modification of the first embodiment, a ball valve 31 as a valve element is provided for opening and closing a discharge valve 30. The ball valve 31 is fixed with a cylindrical member 32 by welding or the like. The cylindrical member 32 has the outlet portion 129, which is provided with a stopper 33. The stopper 33 has a fuel passage therein. The stopper 33 is supported by the inner wall of the discharge passage 125.

A cylindrical member 34 is provided to the end of the stopper 33 at the side of the compression chamber 123. The cylindrical member 34 supports the inner wall of the cylindrical member 32, thereby to axially guide the movement of the cylindrical member 32. The outer wall of the cylindrical member 34 has a groove portion 35. The groove portion 35 communicates a space, which is surrounded by the cylindrical member 32, the ball valve 31, and the cylindrical member 34, with the discharge passage 125.

A spring 36 is provided between the cylindrical member 32 and the stopper 33. The spring 36 biases the cylindrical member 32 toward the compression chamber 123, thereby seating the ball valve 31 to the valve seat portion 23.

The passage 14, which is equivalent to that in the first embodiment, is provided in the ball valve 31. The pin 17 is accommodated in the passage 14. The clearance 20 is defined between the inner wall of the passage 14 and the outer wall of the pin 17. The press-fitted portion 18 of the pin 17 is press-fitted to the inner wall of the passage 14, thereby being fixed to the passage 14. The press-fitted portion 18 has the notch portion 19, which communicates the inlet of the passage 14 with the outlet of the passage 14.

In the present structure, the downstream of the ball valve 31 communicates with the upstream of the ball valve 31 through the clearance 20 and the notch portion 19. The present structure is configured to return fuel from the downstream of the discharge valve 30 to the upstream of the discharge valve 30 through the clearance 20. Thus, fuel returning to the upstream of the discharge valve 30 can be set significantly small.

Second Embodiment

According to the present embodiment shown in FIGS. 8, 9, a clearance is defined by shifting the center axis of a hole in a component. That is, the structure of the present second embodiment is dissimilar to the structure in the first embodiment, in which the clearance 20 is defined between the inner wall of the passage 14 and the outer wall of the pin 17, which is accommodated in the passage 14. Also in the present embodiment, multiple members are combined to define a device, which is equivalent to the throttle portion.

As shown in FIG. 8, a passage 42 is provided in the bottom portion of a valve element 41. The passage 42 has a large-diameter passage portion 43 and a small-diameter passage portion 44. The large-diameter passage portion 43 accommodates three sheet members 45. The three sheet members 45 are stacked such that the axial direction of the passage 42 substantially coincides with the thickness direction of each sheet member 45. The three sheet members 45 are equivalent to an in-passage member and a plate member. The valve element 41 accommodates the three sheet members 45. The valve element 41 has the passage 42, which is equivalent to a fourth passage.

As shown in FIG. 9, a passage hole 46 is provided in each of the three sheet members 45. The passage hole 46 is a larger than the microscopic hole. The center axes of the passage holes 46, which are respectively provided in the three sheet members 45, do not coincide to each other, but are shifted from each other in the radial direction.

In the present structure, the passage holes 46 are radially shifted from each other, thereby forming a throttle hole 47 shown in FIG. 9. The throttle hole 47 is equivalent to the throttle portion.

In the present structure, the downstream of the valve element 41 communicates with the upstream of the through the valve element 41 through the passage 42 and the throttle hole 47. The present structure is configured to return fuel from the downstream of a discharge valve 40 to the upstream of the discharge valve 40 through the throttle hole 47. Thus, the fuel returning to the upstream of the discharge valve 40 can be significantly reduced.

Since the throttle hole 47 can be formed only by shifting the positions of the passage holes 46 from each other, the diameter of the throttle hole 47 can be set significantly small. Therefore, the fuel returning to the upstream of the discharge valve 40 can be significantly reduced. In addition, the diameter of each passage hole 46 may be relatively large. Therefore, the sheet member 45 can be easily manufactured.

Each sheet member 45 is provided with a positioning portion 48 for determining a physical relationship of each passage hole 46. Therefore, the throttle hole 47 can be easily formed to be in the predetermined shape. The shape and structure of the positioning portion 48 may be arbitrary determined. For example, as shown in FIG. 9, a recess may be provided to the sheet member 45, and the recess may be fitted to a projected portion of the inner wall of the large-diameter passage portion 43.

Also in the present embodiment, the discharge passage 125, which accommodates the valve element 41 of the discharge valve 40, and the passage 42 of the valve element 41 are used as the fuel passage for communicating the downstream of the discharge valve 40 with the upstream. Therefore, an additional passage for communicating the downstream of the discharge valve 40 with the upstream need not be provided in the cylinder 120. Thus, the number of the components can be significantly reduced.

Third Embodiment

According to the first and second embodiments, the fuel returning to the upstream of the discharge valve 11, 30, 40 is decreased by reducing the clearance 20 and the diameter of the throttle hole 47. In the present embodiment shown in FIG. 10, the fuel returning to the upstream of a discharge valve 50 is significantly decreased by enhancing flow resistance. Also in the present embodiment, multiple members are combined to define a device, which is equivalent to the throttle portion.

As shown in FIG. 10, a passage 52 is provided in the bottom portion of a valve element 51. The passage 52 has a large-diameter passage portion 53 and a small-diameter passage portion 54. The large-diameter passage portion 53 accommodates three cup members 55, which are stacked in piles and each being in a cup-shape. The three cup members 55 are equivalent to an in-passage member and a cup member. The valve element 51 accommodates the three cup members 55. The valve element 51 has the passage 52, which is equivalent to a sixth passage.

Each of the three cup members 55 has a bottom portion 56, which is provided with a large-diameter throttle portion 57. The large-diameter throttle portion 57 is larger than the microscopic hole. The large-diameter throttle portions 57, which are respectively provided in the bottom portions 56 of the cup members 55, are arranged along the fuel flow. The downstream of the valve element 51 communicates with the upstream of the valve element 51 through the passage 52 and the three large-diameter throttle portions 57.

Flow resistance caused in one of the large-diameter throttle portions 57 is smaller than the flow resistance caused by the microscopic hole. However, in the present structure, the three large-diameter throttle portions 57 are arranged along the fuel flow, so that flow resistance caused through the three large-diameter throttle portions 57 can be set to be larger than the flow resistance caused by the microscopic hole. Fuel returns from the downstream of the discharge valve 50 to the upstream of the discharge valve 50 after passing through the three large-diameter throttle portions 57. Thus, the fuel returning to the upstream of the discharge valve 50 can be significantly reduced.

Also in the present embodiment, the discharge passage 125, which accommodates the valve element 51 of the discharge valve 50, and the passage 52 of the valve element 51 are used as the fuel passage for communicating the downstream of the discharge valve 50 with the upstream. Therefore, an additional passage for communicating the downstream of the discharge valve 50 with the upstream need not be provided in the cylinder 120. Thus, the number of the components can be significantly reduced.

Fourth Embodiment

As shown in FIGS. 11, 12, in the present fourth embodiment, a high-pressure fuel pump 60 includes a relief valve 61 for restricting fuel pressure in the downstream of the high-pressure fuel pump 60 from abnormally increasing. In the present fourth embodiment, the relief valve 61 is not fitted to the fuel pipe 113 in the downstream of the high-pressure fuel pump 60, but fitted to the cylinder 120.

As shown in FIG. 11, a return passage 62 is provided for communicating the downstream of a discharge valve 70 with the upstream of the discharge valve 70 in the cylinder 120. One end of the return passage 62 opens in the sidewall of the discharge passage 125 at the downstream of a valve element 71 of the discharge valve 70, and the other end of the return passage 62 opens to the compression chamber 123.

The cylinder 120 has an accommodation hole 66, which extends toward the return passage 62. The accommodation hole 66 accommodates a valve element 63, a spring 64, and a stopper 65, which are components of the relief valve 61. The accommodation hole 66 divides the return passage 62 into one portion at the side of the discharge valve 70 and the other portion at the side of the compression chamber 123. The inner wall of the accommodation hole 66 has openings communicating with the one portion of the return passage 62 at the side of the discharge valve 70 and the other portion of the return passage 62 at the side of the compression chamber 123.

A valve seat portion 67 is provided in the circumference of the accommodation hole 66 in the vicinity of the opening of the one portion of the return passage 62 at the side of the discharge valve 70. The valve element 63 is configured to be seated to the valve seat portion 67. The valve element 63 is supported in the accommodation hole 66 and axially movable along the inner wall of the accommodation hole 66. The stopper 65 is provided in the accommodation hole 66 to regulate the movement of the valve element 63. A female screw portion is provided in the inner wall of the accommodation hole 66, and a male screw portion is provided in the outer wall of the stopper 65. The stopper 65 is fixed to the accommodation hole 66 by screwing the male screw portion into the female screw portion.

The spring 64 is provided between the valve element 63 and the stopper 65. The spring 64 regularly biases the valve element 63 toward the valve seat portion 67. For example, when fuel pressure in the downstream of the high-pressure fuel pump 60 abnormally increases, differential pressure between the downstream of the discharge valve 70 and the compression chamber 123 increases. In this case, when the valve element 63 is exerted with force caused by the differential pressure larger than the biasing force of the spring 64, the valve element 63 is lifted from the valve seat portion 67. The set load of the spring 64 can be controlled by adjusting the fixed position of the stopper 65.

As shown in FIG. 12, the valve element 63 is substantially in a columnar shape. The valve element 63 has a large diameter portion 68, which supports one end of the spring 64, and a small diameter portion 69, which is seated to the valve seat portion 67. The large diameter portion 68 is supported in the accommodation hole 66 and axially movable in the accommodation hole 66. The sidewall of the large diameter portion 68 is provided with a groove portion 75. The circumferential periphery of the small diameter portion 69 and the inner wall of the accommodation hole 66 therebetween define a space. The portion of the return passage 62 at the side of the compression chamber 123 is opened to communicate with the space between the small diameter portion 69 and the accommodation hole 66.

A passage 76 is provided in the valve element 63 to pass through both the large diameter portion 68 and the small diameter portion 69. The passage 76 has a large-diameter passage portion 77 at the side of the large diameter portion 68 and a small-diameter passage portion 78 at the side of the small diameter portion 69. The passage 76 accommodates a bar-shaped pin 79, which is equivalent to that in the first embodiment. The pin 79 has a press-fitted portion 80 at one end, and the press-fitted portion 18 can be press-fitted into the large-diameter passage portion 77.

The press-fitted portion 80 of the pin 79 is press-fitted to the large-diameter passage portion 77, so that the pin 79 is fixed in the passage 76. In the present structure, the outer wall of the pin 79 and the inner wall of the small-diameter passage portion 78 therebetween define a small clearance 81. The press-fitted portion 80 has a notch portion 82 for communicating the inlet of the passage 76 with the outlet of the passage 76. The clearance 81 is equivalent to the throttle portion.

In the present structure, the downstream of the discharge valve 70 communicates with the upstream of the discharge valve 70 through the portion of the return passage 62 at the side of the discharge valve 70, the clearance 81, the notch portion 82, the space between the valve element 63 and the stopper 65, the groove portion 75, the portion of the return passage 62 at the side of the compression chamber 123. The present structure is configured to return fuel from the downstream of the discharge valve 70 to the upstream of the discharge valve 70 through the clearance 81. Thus, the fuel returning to the upstream of the discharge valve 70 can be significantly reduced.

In the present embodiment, the return passage 62 and the accommodation hole 66, which accommodates the valve element 63 of the relief valve 61, are used as the fuel passage for communicating the downstream of the discharge valve 70 with the upstream of the discharge valve 70. Therefore, an additional passage for communicating the downstream of the discharge valve 70 with the upstream need not be provided in the cylinder 120. Thus, the number of the components can be significantly reduced.

Furthermore, in the present embodiment, the clearance 81 is provided to restrict the fuel returning from the downstream of the discharge valve 70 to the upstream. In addition, the clearance 81 is provided in the valve element 63 of the relief valve 61, which does not regularly move to open and close. Therefore, the valve element 71 of the discharge valve 70 can be restricted from increasing in weight, even in the present structure in which the clearance 81 is provided. Thus, response in opening and closing of the valve element 71 of the discharge valve 70 can be maintained.

Fifth Embodiment

The present embodiment shown in FIG. 13 is a combination of the sheet member 45 (FIG. 8) in the second embodiment and a valve element 91 of a relief valve 90. As shown in FIG. 13, a passage 92 is provided in the valve element 91. The passage 92 has a large-diameter passage portion 93 and a small-diameter passage portion 94. The structure of the valve element 91 in the present embodiment is substantially equivalent to the structure of the valve element 63 shown in FIG. 12, and therefore detailed description is omitted.

The large-diameter passage portion 93 accommodates three sheet members 95. The three sheet members 95 are stacked such that the axial direction of the passage 92 substantially coincides with the thickness direction of each sheet member 95. The valve element 91 accommodates the three sheet members 95. The valve element 91 has the passage 92, which is equivalent to a fifth passage.

Passage holes 96 are respectively provided in the sheet member 95. The center axes of the passage holes 96, which are respectively provided in the three sheet members 95, do not coincide to each other, but are shifted from each other in the radial direction. The passage holes 96 are shifted from each other in the radial direction, so that a throttle hole 97 is formed in the sheet members 95, similarly to the throttle hole 47 shown in FIG. 9.

In the present structure, the downstream of the discharge valve 70 communicates with the upstream of the discharge valve 70 through the portion of the return passage 62 at the side of the discharge valve 70, the passage 92, the throttle hole 97, the space between the valve element 91 and the stopper 65, a groove portion 98, the portion of the return passage 62 at the side of the compression chamber 123. The present structure is configured to return fuel from the downstream of the discharge valve 70 to the upstream of the discharge valve 70 through the throttle hole 97. Thus, the fuel returning to the upstream of the discharge valve 70 can be significantly reduced.

In the present embodiment, the return passage 62, the accommodation hole 66, which accommodates the valve element 91 of the relief valve 90, and the passage 92 are used as the fuel passage for communicating the downstream of the discharge valve 70 with the upstream of the discharge valve 70, similarly to the fourth embodiment. Therefore, an additional passage for communicating the downstream of the discharge valve 70 with the upstream need not be provided in the cylinder 120. Thus, the number of the components can be significantly reduced.

Furthermore, in the present embodiment, the throttle hole 97 is provided to restrict the fuel returning from the downstream of the discharge valve 70 to the upstream. In addition, the throttle hole 97 is provided in the valve element 91 of the relief valve 90, which does not regularly move to open and close. Therefore, the valve element 71 of the discharge valve 70 can be restricted from increasing in weight, even in the present structure in which the throttle hole 97 is provided. Thus, response in opening and closing of the valve element 71 of the discharge valve 70 can be maintained.

Sixth Embodiment

The present embodiment shown in FIG. 14 is a combination of the cup members 55 (FIG. 10) in the third embodiment and a valve element 101 of a relief valve 100. As shown in FIG. 14, a passage 102 is provided in the valve element 101. The passage 102 has a large-diameter passage portion 103 and a small-diameter passage portion 104. The structure of the valve element 101 in the present embodiment is substantially equivalent to the structure of the valve element 63 shown in FIG. 12, and therefore detailed description is omitted.

The large-diameter passage portion 103 accommodates three cup members 105, which are stacked. The valve element 101 accommodates the three cup members 105. The valve element 101 has the passage 102, which is equivalent to a seventh passage.

Each of the three cup members 105 has a bottom portion 106, which is provided with a large-diameter throttle portion 107. The large-diameter throttle portions 107, which are respectively provided in the bottom portions 106 of the cup members 105, are arranged along the fuel flow.

In the present structure, the downstream of the discharge valve 70 communicates with the upstream of the discharge valve 70 through the portion of the return passage 62 at the side of the discharge valve 70, the passage 102, the large-diameter throttle portion 107, the space between the valve element 101 and the stopper 65, a groove portion 108, the portion of the return passage 62 at the side of the compression chamber 123.

Flow resistance caused in one of the large-diameter throttle portions 107 is S smaller than the flow resistance caused by the microscopic hole. However, in the present structure, the three large-diameter throttle portions 107 are arranged along the fuel flow, so that flow resistance caused through the three large-diameter throttle portions 107 can be set to be larger than the flow resistance caused by the microscopic hole.

Fuel returns from the downstream of the discharge valve 70 to the upstream of the discharge valve 70 after passing through the three large-diameter throttle portions 107. Thus, the fuel returning to the upstream of the discharge valve 70 can be significantly reduced.

In the present embodiment, the return passage 62, the accommodation hole 66, which accommodates the valve element 101 of the relief valve 100, and the passage 102 are used as the fuel passage for communicating the downstream of the discharge valve 70 with the upstream of the discharge valve 70, similarly to the fourth embodiment. Therefore, an additional passage for communicating the downstream of the discharge valve 70 with the upstream need not be provided in the cylinder 120. Thus, the number of the components can be significantly reduced.

Furthermore, in the present embodiment, the large-diameter throttle portion 107 is provided to restrict the fuel returning from the downstream of the discharge valve 70 to the upstream. In addition, the throttle hole 97 is provided in the valve element 101 of the relief valve 100, which does not regularly move to open and close. Therefore, the valve element 71 of the discharge valve 70 can be restricted from increasing in weight, even in the present structure in which the large-diameter throttle portion 107 is provided. Thus, response in opening and closing of the valve element 71 of the discharge valve 70 can be maintained.

Seventh Embodiment

The present seventh embodiment shown in FIGS. 15, 16 utilizes the return passage 62, which is provided in the cylinder 120 of the high-pressure fuel pump 60 provided with the relief valve 61, 90, 100 according to the fourth to sixth embodiments, and the accommodation hole 66.

As shown in FIG. 157 the return passage 62 is provided for communicating the downstream of the discharge valve 70 with the upstream of the discharge valve 70 in the cylinder 120. One end of the return passage 62 opens in the sidewall of the discharge passage 125 at the downstream of the valve element 71 of the discharge valve 70, and the other end of the return passage 62 opens to the compression chamber 123.

The accommodation hole 66 extends toward the return passage 62 in the cylinder 120. The accommodation hole 66 accommodates a passage member 200, which have a passage 201 therein, and the like. The accommodation hole 66 divides the return passage 62 into one portion on the side of the discharge valve 70 and the other portion on the side of the compression chamber 123. The inner wall of the accommodation hole 66 has openings communicating with the one portion of the return passage 62 at the side of the discharge valve 70 and the other portion of the return passage 62 at the side of the compression chamber 123.

The passage 201, which is provided in the passage member 200, is an exhaust passage to exhaust fuel. Specifically, the passage 201 is supplied from the portion of the return passage 62 at the side of the discharge valve 70 to the portion of the return passage 62 at the side of the compression chamber 123. The passage member 200 is biased from a lid member 202 toward the bottom portion of the accommodation hole 66, thereby being fixed.

As shown in FIG. 16, the passage 201 accommodates a pin 203, which is equivalent to that in the first and fourth embodiments. The pin 203 has a press-fitted portion 204 at one end, and the press-fitted portion 204 can be press-fitted into the passage 201. The press-fitted portion 204 is press-fitted into the passage 201, whereby the pin 203 is fixed in the passage 201. A small clearance 205 is defined between the outer wall of the pin 203 and the inner wall of the passage 201 by fixing the pin 203 in the passage 201. The press-fitted portion 204 has a notch portion 206 for communicating the inlet of the passage 201 with the outlet of the passage 201.

In the present structure, the downstream of the discharge valve 70 communicates with the upstream of the discharge valve 70 through the portion of the return passage 62 at the side of the discharge valve 70, the clearance 205, the notch portion 206, and the portion of the return passage 62 at the side of the compression chamber 123. The present structure is configured to return fuel from the downstream of the discharge valve 70 to the upstream of the discharge valve 70 through the clearance 205. Thus, the fuel returning to the upstream of the discharge valve 70 can be significantly reduced.

In the present embodiment, the cylinder 120 can be used in the fuel feed system, which has the relief valve 115 outside the high-pressure fuel pump 10, shown in FIG. 1. Furthermore, the cylinder 120 can be also commonly used in the structure in which the relief valve 61, 90, 100 is accommodated inside the high-pressure fuel pump 60. Thus, commonality of components can be enhanced.

Eighth Embodiment

In the present eighth embodiment shown in FIG. 17, the sheet members 45, 95 (FIGS. 8, 13) in the second and fifth embodiments are applied to a passage member 210. As shown in FIG. 17, a passage 211 is provided in the passage member 210. The structure of the passage member 210 in the present embodiment is substantially equivalent to the structure of the passage member 200 shown in FIG. 16, and therefore detailed description is omitted.

The passage 211 accommodates three sheet members 212. The three sheet members 212 are stacked such that the axial direction of the passage 211 substantially coincides with the thickness direction of each sheet member 95. Passage holes 213 are respectively provided in the sheet members 212. The center axes of the passage holes 213, which are respectively provided in the three sheet members 212, do not coincide to each other, but are shifted from each other in the radial direction. The passage holes 213 are shifted from each other in the radial direction, so that a throttle hole 214 is formed in the sheet members 212, similarly to the throttle hole 47 shown in FIG. 9.

In the present structure, the downstream of the discharge valve 70 communicates with the upstream of the discharge valve 70 through the portion of the return passage 62 at the side of the discharge valve 70, the passage 211, the throttle hole 214, and the portion of the return passage 62 at the side of the compression chamber 123. The present structure is configured to return fuel from the downstream of the discharge valve 70 to the upstream of the discharge valve 70 through the throttle hole 214. Thus, the fuel returning to the upstream of the discharge valve 70 can be significantly reduced.

In the present embodiment, the cylinder 120 can be used in the fuel feed system, which has the relief valve 115 outside the high-pressure fuel pump 10, shown in FIG. 1. Furthermore, the cylinder 120 can be also commonly used in the structure in which the relief valve 61, 90, 100 is accommodated inside the high-pressure fuel pump 60. Thus, commonality of components can be enhanced.

Ninth Embodiment

In the present ninth embodiment shown in FIG. 18, the cup members 55, 105 (FIGS. 10, 14) in the third and sixth embodiments are applied to a passage member 220. As shown in FIG. 18, a passage 221 is provided in the passage member 220. The structure of the passage member 220 in the present embodiment is substantially equivalent to the structure of the passage member 200 shown in FIG. 16, and therefore detailed description is omitted.

The passage 221 accommodates three cup members 222, which are stacked. Each of the three cup members 222 has a bottom portion 223, which is provided with a large-diameter throttle portion 224. The large-diameter throttle portions 224, which are respectively provided in the bottom portions 223 of the cup members 222, are arranged along the fuel flow.

In the present structure, the downstream of the discharge valve 70 communicates with the upstream of the discharge valve 70 through the portion of the return passage 62 at the side of the discharge valve 70, the passage 221, the large-diameter throttle portion 224, and the portion of the return passage 62 at the side of the compression chamber 123.

Flow resistance caused in one of the large-diameter throttle portions 224 is smaller than the flow resistance caused by the microscopic hole. However, in the present structure, the three large-diameter throttle portions 224 are arranged along the fuel flow, so that flow resistance caused through the three large-diameter throttle portions 224 can be set to be larger than the flow resistance caused by the microscopic hole.

Fuel returns from the downstream of the discharge valve 70 to the upstream of the discharge valve 70 after passing through the three large-diameter throttle portions 224. Thus, the fuel returning to the upstream of the discharge valve 70 can be significantly reduced.

In the present embodiment, the cylinder 120 can be used in the fuel feed system, which has the relief valve 115 outside the high-pressure fuel pump 10, shown in FIG. 1. Furthermore, the cylinder 120 can be also commonly used in the structure in which the relief valve 61, 90, 100 is accommodated inside the high-pressure fuel pump 60. Thus, commonality of components can be enhanced.

Tenth Embodiment

As shown in FIG. 19, in the tenth embodiment, a discharge valve 230 includes a valve element 231. The bottom portion of the valve element 231 has a passage 232 for communicating the inside of the valve element 231 with the outer wall surface of the bottom portion of the valve element 231. The passage 232 regularly communicates the compression chamber 123 with the outlet portion 129, even in the state where the valve element 231 is seated to a valve seat portion 233. The valve element 231 is equivalent to the passage member, and the passage 232 is equivalent to the second passage.

The passage 232 has a large-diameter passage portion 234 at the side of the compression chamber 123. The passage 232 further has a small-diameter passage portion 235 at the side of the outlet portion 129. The large-diameter passage portion 234 accommodates two disk members 236. The two disk members 236 are stacked such that the axial direction of the passage 232 substantially coincides with the thickness direction of each disk member 236. In the present structure, the valve element 231 can be significantly restricted from being increased in size with respect to the axial direction.

The two disk members 236 are accommodated in the large-diameter passage portion 234 and biased to a step portion 237 between the large-diameter passage portion 234 and the small-diameter passage portion 235. In the present structure, the disk member 236, which is relatively large with respect to the radial direction, can be accommodated in the passage 232. The two disk members 236 include an outer disk member 238, which is located at the outer side. The outer disk member 238 has a through hole 239, which passes substantially through the center with respect to the thickness direction.

The outer circumferential portion of the outer disk member 238 is entirely welded with the inner wall of the large-diameter passage portion 234, whereby the outer disk member 238 is joined with the large-diameter passage portion 234. The through hole 239 is equivalent to a first communication passage.

The two disk members 236 further include an inner disk member 240. The inner disk member 240 has the outer diameter, which is smaller than the inner diameter of the large-diameter passage portion 234. The inner disk member 240 has a sidewall with respect to the radial direction, and the sidewall and the inner wall of the large-diameter passage portion 234 therebetween define a clearance 241. The inner disk member 240 has a sidewall 242 at the side of the step portion 237 with respect to the thickness direction. The sidewall 242 has a groove portion 243, which communicates the small-diameter passage portion 235 with the clearance 241. The groove portion 243 and the clearance 241 are equivalent to the second communication passage.

The inner disk member 240 has a sidewall 244 at the side of the outer disk member 238 with respect to the thickness direction. The outer disk member 238 has a sidewall 245 at the side of the inner disk member 240 with respect to the thickness direction. The surface of the sidewall 244 is coarser than the surface of the sidewall 245. In the present structure, the inner disk member 240 and the outer disk member 238 therebetween define a small clearance 246, which is configured to pass fuel therethrough. The small clearance 246 is equivalent to the throttle portion. The clearance 246 communicates with the through hole 239. A groove may be provided in the sidewall 245 of the outer disk member 238 or the sidewall 244 of the inner disk member 240, whereby the outer disk member 238 and the inner disk member 240 may therebetween define a clearance.

In the present structure, the downstream of the discharge valve 70 communicates with the upstream of the discharge valve 70 through the passage 232, the groove portion 243, the clearance 241, the clearance 246, and the through hole 239. The present structure is configured to return fuel from the downstream of the discharge valve 230 to the upstream of the discharge valve 230 through the clearance 246. Thus, the fuel returning to the upstream of the discharge valve 230 can be significantly reduced.

In the present embodiment, the surface of the sidewall 244 of the inner disk member 240 is coarser than the surface of the sidewall 245 of the outer disk member 238. Alternatively, the surface of the sidewall 245 of the outer disk member 238 may be coarser than the surface of the sidewall 244 of the inner disk member 240. It suffices that the surfaces of the sidewalls 244, 245, which are opposed to each other, are different from each other in coarseness. The inner disk member 240 may be formed from a material, such as resin, which is lower than a metallic material in rigidity.

In the present embodiment, the disk member 236 is provided in the valve element 231 of the discharge valve 230. Alternatively, the disk member 236 according to the present embodiment may be provided in the relief valve 61, 90, 100. A passage may be additionally provided in the cylinder 120, and the disk member 236 according to the present embodiment may be provided in the passage of the cylinder 120.

Eleventh Embodiment

In the present eleventh embodiment shown in FIGS. 20 to 22, the shape of a disk member 252, which is provided in a valve element 251 of a discharge valve 250, is different from the shape of the disk member 236 in the tenth embodiment. As shown in FIG. 21, the outer circumferential portion of an inner disk member 253 partially has a notch portion 254. The sidewall of the inner disk member 253 at the side of a step portion 264 has a groove portion 256, which communicates the notch portion 254 with a small-diameter passage portion 255.

The bottom portion of the valve element 251 has a passage 352 for communicating the inside of the valve element 251 with the outer wall surface of the bottom portion of the valve element 251. The passage 322 is equivalent to the second passage.

An outer disk member 257 is a disc-shaped member, which does not have the through hole 239 dissimilarly to the outer disk member 238 in the tenth embodiment. The outer disk member 257 has the outer diameter, which is smaller than the inner diameter of a large-diameter passage portion 258. The sidewall of the outer disk member 257 and the inner wall of the large-diameter passage portion 258 therebetween define a clearance 259.

Also in the present embodiment, the surface of a sidewall 260 of the inner disk member 253 is coarser than the surface of a sidewall 261 of the outer disk member 257. In the present structure, the sidewall 260 of the inner disk member 253 and the sidewall 261 of the outer disk member 257 therebetween define a small clearance 262, which is configured to pass fuel therethrough. The clearance 262 is equivalent to the throttle portion.

In the present embodiment, as shown in FIG. 22, the outer circumferential portion of the outer disk member 257 and the inner wall of the large-diameter passage portion 258 are partially welded to each other to form a non-weld portion 263. Whereby, the outer disk member 257 is joined with the large-diameter passage portion 258. The non-weld portion 263 communicates with the clearance 262 through the clearance 259, which is defined between the sidewall of the outer disk member 257 with respect to the radial direction and the inner wall of the large-diameter passage portion 258.

In the present structure, the downstream of the valve element 251 communicates with the upstream of the valve element 251 through the small-diameter passage portion 255, the groove portion 256, the notch portion 254, the clearance 262, the clearance 259, and the non-weld portion 263. The present structure is configured to return fuel from the downstream of the discharge valve 250 to the upstream of the discharge valve 250 through the clearance 262. Thus, the fuel returning to the upstream of the discharge valve 250 can be significantly reduced.

In the present embodiment, the passage, which communicates with the clearance 262, can be easily provided by welding, without modification of the outer disk member 257.

The disk member 252 according to the present embodiment may be provided in the relief valve 61, 90, 100. A passage may be additionally provided in the cylinder 120, and the disk member 252 according to the present embodiment may be provided in the additional passage,

Twelfth and Thirteenth Embodiments

As shown in FIG. 23, in the present twelfth embodiment, an outer disk member 272 is provided in a valve element 271 of a discharge valve 270. The outer disk member 272 has a sidewall 273, which is provided with a male screw portion 275 substantially at a center portion. The male screw portion 275 extends into a small-diameter passage portion 274. A female screw portion 276 is provided in the small-diameter passage portion 274. An inner disk member 279 is provided between the outer disk member 272 and a step portion 277. The male screw portion 275 of the outer disk member 272 is screwed into the female screw portion 276 of the small-diameter passage portion 274. In the present structure, the sidewall 273 of the outer disk member 272 biases the inner disk member 279 onto the step portion 277.

The bottom portion of the valve element 271 has a passage 372 for communicating the inside of the valve element 271 with the outer wall surface of the bottom portion of the valve element 271. The passage 372 is equivalent to the second passage.

The inner disk member 279 has a hole 280 substantially at a center portion. The male screw portion 275 passes through the hole 280 of the inner disk member 279. The male screw portion 275 and the female screw portion 276 therebetween define a clearance 281, which communicates the small-diameter passage portion 274 with the hole 280. The surface of a sidewall 282 of the inner disk member 279 is coarser than the surface of a sidewall 283 of the outer disk member 272. In the present structure, the inner disk member 279 and the outer disk member 272 therebetween define a small clearance 284, which is configured to pass fuel therethrough. The clearance 284 is equivalent to the throttle portion.

In the present structure, the downstream of the valve element 271 communicates with the upstream of the valve element 271 through the small-diameter passage portion 274, the clearance 281, the hole 280, the clearance 284, and the clearance between the sidewall of the outer disk member 272 with respect to the radial direction and the inner wall of a large-diameter passage portion 285. The present structure is configured to return fuel from the downstream of the discharge valve 270 to the upstream of the discharge valve 270 through the clearance 284. Thus, the fuel returning to the upstream of the discharge valve 270 can be significantly reduced.

Furthermore, in the present embodiment, the outer disk member 272 is mounted to the valve element 271 by interposing the inner disk member 279 between the outer disk member 272 and the step portion 277 and screwing the male screw portion 275 into the female screw portion 276 of the small-diameter passage portion 274. In the present structure, contact pressure between the inner disk member 279 and the outer disk member 272 can be controlled. Consequently, the fuel returning through the clearance 284 can be easily controlled.

As shown in FIG. 24, in the thirteenth embodiment, the outer disk member 272 and the inner disk member 279 are integrated to a disk member 286. In the present structure, the male screw portion 275 is provided substantially in the center portion of the disk member 286. The surface of a sidewall 287 of the disk member 286 at the side of the step portion 277 is coarser than the surface of the step portion 277. The male screw portion 275 is screwed into the female screw portion 276 of the small-diameter passage portion 274. In the present structure, the sidewall 287 of the disk member 286 and the step portion 277 therebetween define a small clearance 288, which is configured to pass fuel therethrough. The male screw portion 275 is screwed into the female screw portion 276, whereby the disk member 286 is accommodated in the large-diameter passage portion 285. In the present thirteenth embodiment, the small-diameter passage portion 274 and the large-diameter passage portion 285 are equivalent to a third passage.

In the twelfth and thirteenth embodiments, the female screw portion 276 is provided into the small-diameter passage portion 274. In the present structure, the valve element 271 need not be additionally provided with a hole or the like for defining a female screw portion.

The outer disk member 272 and the inner disk member 279 according to the twelfth embodiment or the disk member 286 according to the thirteenth embodiment may be provided in the relief valve 61, 90, 100. A passage may be additionally provided in the cylinder 120. In this case, the outer disk member 272 and the inner disk member 279 according to the twelfth embodiment or the disk member 286 according to the thirteenth embodiment may be provided in the additional passage of the cylinder 120.

Fourteenth Embodiment

As shown in FIG, 25, in the present fourteenth embodiment, a valve element 291 of a discharge valve 290 has a passage 292. A disk member 294 as a single component is accommodated in a large-diameter passage portion 293 of the passage 292. The outer diameter of the disk member 294 is smaller than the inner diameter of the large-diameter passage portion 293. The disk member 294 is accommodated in the large-diameter passage portion 293. In the present structure, the sidewall of the disk member 294 with respect to the radial direction and the inner wall of the large-diameter passage portion 293 therebetween define a small clearance 295. The clearance 295 is equivalent to the throttle portion. The passage 292 is equivalent to the third communication passage.

As shown in FIG. 26, the outer circumferential portion of the disk member 294 and the inner wall of the large-diameter passage portion 293 are partially welded to each other to form a non-weld portion 296. Whereby, the disk member 294 is joined with the large-diameter passage portion 293. The non-weld portion 296 communicates with the clearance 295 through a small-diameter passage portion 297.

The downstream of the valve element 291 communicates with the upstream of the valve element 291 through the small-diameter passage portion 297, the clearance 295, and the non-weld portion 296. The present structure is configured to return fuel from the downstream of the discharge valve 290 to the upstream of the discharge valve 290 through the clearance 295. Thus, the fuel returning to the upstream of the discharge valve 290 can be significantly reduced.

The disk member 294 according to the present embodiment may be provided in the relief valve 61, 90, 100. A passage may be additionally provided in the cylinder 120, and the disk member 294 according to the present embodiment may be provided in the additional passage.

Other Embodiments

The structure of the positioning portion 48 according to the second embodiment may be applied to the disc members 96, 212 according to the fifth and eighth embodiment.

The structures between the disc members 238, 240, 253, 257, 272, 279 according to the tenth to twelfth embodiments may be applied to any one of the relief valve 61, 90, 100 according to the fourth to sixth embodiments.

The structure between the disc member 286 and the valve element 271 according to the thirteenth embodiment may be applied to any one of the relief valve 61, 90, 100 according to the fourth to sixth embodiments.

In the first to fourteenth embodiments, a conventional pressure control valve, which permits fuel to flow from the downstream of the discharge valve 11, 30, 40, 50, 70, 230, 250, 270, 290 to the upstream may be provided for controlling differential pressure. In this case, the conventional pressure control valve may be provided to the downstream or the upstream of the clearance 20, 81, 205, 246, 262, 284, 288, 295, the throttle hole 47, 97, 214, or the large-diameter throttle portion 57, 107, 224 as the throttle portion.

In the above embodiments, the throttle structure is applied to the high-pressure fuel pump for a gasoline direct injection system. Alternatively, the throttle structure may be applied to, for example, a high-pressure fuel pump for a fuel feed system for a diesel engine.

The above structures of the embodiments can be combined as appropriate. Various modifications and alternations may be diversely made to the above embodiments without departing from the spirit of the present invention.

What is claimed is:

1. A high-pressure fuel pump for pressurizing fuel and for supplying fuel to an internal combustion engine, the high-pressure fuel pump comprising:

a pump housing having a compression chamber;

a plunger supported by the pump housing, the plunger reciprocatable for pressurizing fuel drawn in the compression chamber;

a discharge valve configured to open to supply fuel in the compression chamber to the internal combustion engine when pressure in the compression chamber is more than predetermined pressure;

a fuel passage configured to communicate a downstream side of the discharge valve with an upstream side of the discharge valve; and an in-passage member accommodated in the fuel passage, wherein the in-passage member includes a plurality of members, which are combined to define a throttle portion for throttling fuel, which returns from the downstream side of the discharge valve to the upstream side of the discharge valve, the in-passage member includes two members, the two members respectively have surfaces, which are closely in contact with each other and therebetween define the throttle portion, one of the surfaces being closely in contact with each other is coarser than an other of the surfaces, one of the two members of the in-passage member has a passage therein, an other of the two members is a bar member accommodated in the passage, the throttle portion is a clearance between an inner wall of the passage and an outer wall of the bar member, the bar member has a press-fitted portion, which is press-fitted in the passage, and a throttle forming portion, and the press-fitted portion has a notch portion, which communicates an inlet side of the passage with an outlet side of the passage.

2. The high-pressure fuel pump according to claim 1, wherein the pump housing defines the fuel passage.

* * * * *